US012569748B2

(12) United States Patent
Rynda et al.

(10) Patent No.: US 12,569,748 B2
(45) Date of Patent: Mar. 10, 2026

(54) HAND-FORMING CARD SHUFFLER

(71) Applicant: AGS LLC, Las Vegas, NV (US)

(72) Inventors: Robert John Rynda, Las Vegas, NV (US); Daniel Arthur Hopkinson, Las Vegas, NV (US); Andrew James Jacobs, Maple Plain, MN (US); John Paul Anton, Columbia Heights, MN (US); Adam Walter Hungerbuhler, Brooklyn Park, MN (US); Craig Walter Oeding, Waconia, MN (US); Benjamin Taylor Roloff, Louis Park, MN (US)

(73) Assignee: AGS LLC, Las Vegas, NV (US)

( * ) Notice: Subject to any disclaimer, the term of this patent is extended or adjusted under 35 U.S.C. 154(b) by 962 days.

(21) Appl. No.: 17/576,441

(22) Filed: Jan. 14, 2022

(65) Prior Publication Data

US 2022/0409985 A1 Dec. 29, 2022

Related U.S. Application Data

(60) Provisional application No. 63/216,352, filed on Jun. 29, 2021.

(51) Int. Cl.
*A63F 1/12* (2006.01)

(52) U.S. Cl.
CPC ..... *A63F 1/12* (2013.01)

(58) Field of Classification Search
CPC ..... A63F 1/12
USPC ..... 273/149 R
See application file for complete search history.

(56) References Cited

U.S. PATENT DOCUMENTS

| | | | |
|---|---|---|---|
| 1,885,276 | A | 11/1932 | Mckay |
| 4,305,577 | A | 12/1981 | Clay et al. |
| 4,513,969 | A | 4/1985 | Samsel, Jr. |
| 4,548,395 | A | 10/1985 | Snellman et al. |
| 4,586,712 | A | 5/1986 | Lorber et al. |
| 4,659,082 | A | 4/1987 | Greenberg |
| 4,822,050 | A | 4/1989 | Normand et al. |
| 4,934,685 | A | 6/1990 | Shifley |
| 5,390,910 | A | 2/1995 | Mandel et al. |
| 5,692,748 | A | 12/1997 | Frisco et al. |
| 5,944,310 | A | 8/1999 | Johnson et al. |

(Continued)

FOREIGN PATENT DOCUMENTS

JP 2006193299 4/2010

OTHER PUBLICATIONS

Notification of Transmittal of the International Search Report and the Written Opinion of the International Searching Authority, or the Declaration for PCT Patent Application No. PCT/US/22/34992, mailed Oct. 6, 2022, 14 pages.

*Primary Examiner* — Joseph B Baldori
(74) *Attorney, Agent, or Firm* — Snell & Wilmer LLP

(57) ABSTRACT

A card handling device is configured to arrange one or more cards into sets or hands. The card handling device may have a card receiving area, a card infeed mechanism for delivering cards from the receiving area to a receiver for forming the card sets or hands, and an ejector for ejecting cards to a card dispensing area. The receiving area may have a card engaging movable sidewall. The card receiver may be movable and have vertically spaced dividers which define card receiving pockets. A top of the card dispensing area is located above a top of the card receiving area.

20 Claims, 18 Drawing Sheets

(56) References Cited

U.S. PATENT DOCUMENTS 5,967,504 A 10/1999 Yankloski
6,149,154 A 11/2000 Grauzer et al.
6,250,632 B1 6/2001 Albrecht
6,299,536 B1 10/2001 Hill
6,367,795 B1 4/2002 Matsuda et al.
6,403,908 B2 6/2002 Stardust et al.
6,644,648 B1 11/2003 Goode
6,651,981 B2 11/2003 Grauzer et al.
6,655,684 B2 12/2003 Grauzer et al.
6,676,127 B2 1/2004 Johnson et al.
6,726,205 B1 4/2004 Purton
6,886,829 B2 5/2005 Hessing et al.
7,255,344 B2 8/2007 Grauzer et al.
7,261,294 B2 * 8/2007 Grauzer ..... A63F 1/12 273/149 P
7,387,268 B2 6/2008 Dahle et al.
7,736,236 B2 6/2010 Soltys et al.
7,766,332 B2 8/2010 Grauzer et al.
8,070,574 B2 12/2011 Grauzer et al.
8,141,875 B2 3/2012 Grauzer et al.
8,342,525 B2 1/2013 Scheper et al.
8,353,513 B2 1/2013 Swanson
8,485,527 B2 * 7/2013 Sampson ..... A63F 1/14 273/149 R
8,505,916 B2 8/2013 Grauzer et al.
8,579,289 B2 11/2013 Rynda et al.
8,646,779 B2 2/2014 Grauzer et al.
8,662,500 B2 3/2014 Swanson
8,702,101 B2 4/2014 Scheper et al.
8,777,710 B2 7/2014 Grauzer et al.
8,800,993 B2 * 8/2014 Blaha ..... A63F 1/12 273/149 R
8,931,779 B2 1/2015 Grauzer et al.
8,960,674 B2 2/2015 Stasson et al.
8,986,091 B2 3/2015 Grauzer et al.
8,998,211 B2 4/2015 Grauzer et al.
9,220,971 B2 12/2015 Rynda et al.
9,259,640 B2 2/2016 Grauzer et al.
9,339,723 B2 5/2016 Grauzer et al.
9,504,905 B2 11/2016 Kelly et al.
9,566,501 B2 * 2/2017 Stasson ..... A63F 1/12
9,573,047 B1 * 2/2017 Riordan ..... A63F 1/14
9,623,317 B2 4/2017 Scheper et al.
9,633,523 B2 4/2017 Grauzer et al.
9,659,461 B2 5/2017 Grauzer et al.
9,700,785 B2 7/2017 Hessing et al.
9,717,979 B2 8/2017 Grauzer et al.
9,731,190 B2 * 8/2017 Sampson ..... A63F 1/12
9,764,221 B2 9/2017 Grauzer et al.
9,901,810 B2 2/2018 Rynda et al.
9,922,502 B2 3/2018 Grauzer et al.
10,008,076 B2 6/2018 Grauzer et al.
10,226,686 B2 3/2019 Scheper et al.
10,279,245 B2 * 5/2019 Sampson ..... A63F 1/12
10,350,481 B2 7/2019 Scheper et al.
10,410,475 B2 9/2019 Grauzer et al.
10,504,337 B2 12/2019 Grauzer et al.
10,525,329 B2 1/2020 Swanson
10,639,542 B2 5/2020 Scheper et al.
10,926,164 B2 2/2021 Rynda et al.
10,933,300 B2 * 3/2021 Helsen ..... A63F 1/12
2003/0052449 A1 * 3/2003 Grauzer ..... A63F 1/12 273/149 R
2004/0108255 A1 6/2004 Johnson
2004/0245720 A1 12/2004 Grauzer et al.
2005/0062228 A1 3/2005 Grauzer et al.
2005/0110210 A1 5/2005 Soltys et al.
2006/0009292 A1 1/2006 Tan
2007/0006708 A1 1/2007 Laakso
2007/0057453 A1 3/2007 Soltys et al.
2007/0102879 A1 5/2007 Stasson
2007/0222147 A1 9/2007 Blaha et al.
2007/0267811 A1 11/2007 Yoseloff et al.
2007/0287534 A1 12/2007 Fleckenstein
2008/0022415 A1 1/2008 Kuo et al.
2013/0236066 A1 9/2013 Shubinsky
2014/0103608 A1 * 4/2014 Grauzer ..... A63F 1/12 273/149 R
2015/0021242 A1 1/2015 Johnson
2015/0328533 A1 11/2015 Haushalter et al.
2019/0060739 A1 2/2019 Stasson et al.
2019/0151746 A1 5/2019 Stasson et al.
2020/0171375 A1 * 6/2020 Litman ..... A63F 1/12

* cited by examiner

HAND-FORMING CARD SHUFFLER

RELATED APPLICATION DATA

The present application claims priority to U.S. Provisional Application Ser. No. 63/216,352, filed Jun. 29, 2021, which application is incorporated herein by reference in its entirety.

FIELD OF THE DISCLOSURE

The present disclosure relates to methods and devices for shuffling cards.

BACKGROUND OF THE DISCLOSURE

Numerous mechanical and electro-mechanical devices have been designed for use in shuffling cards, such as one or more decks of playing cards. Despite the number of different existing designs, various drawbacks or problems are known to exist with such devices.

SUMMARY OF THE DISCLOSURE

One aspect of the disclosure comprises methods and devices for shuffling cards, and more preferably for forming one or more sets or hands of shuffled cards.

In one example, the card shuffler may comprise a housing, a card receiving area, a card receiver, a card infeed mechanism for moving cards from the receiving area to the card receiver, a card ejector for moving cards from the card receiver to a card dispensing area, and at least one controller.

The card receiving area may have an open top which is accessible from an outside of the housing, a bottom, and one or more side and/or end walls which define a periphery or boundary of the card receiving area for cards placed therein. At least one of the walls, such as one of the sidewalls, may have a movable wall portion. The movable wall may be moveable between a retracted position, such as where the movable wall is generally vertically extending, and an extended position, such as where the movable wall extends into the card receiving area for engaging one or more cards therein.

The card infeed mechanism may comprise one or more rollers, including one or more driven rollers, and be configured to move cards from the card receiving area to the card receiver. The card infeed mechanism may be configured to move the card horizontally from the card receiving area to the card receiver.

The card receiver may comprise a plurality of card receiving pockets which are defined by dividers. The dividers, and thus the pockets, may be stacked in a vertical arrangement. The card receiver may be movable, such as by an elevator, vertically between one or more raised positions and one or more lowered positions. The card receiver may be moved to receive one or more cards into different pockets thereof, such as for forming sets or hands of cards, and for aligning the pockets with the card ejector.

The card ejector may comprise a pusher that may be moved between a retracted position and an extended position in which it pushes cards out of an aligned pocket of the card receiver.

Cards are dispensed, such as in sets or hands, to the card dispensing area. In one example, the card dispensing area is separated from the card receiving area by a divider. The top of the card dispensing area is located above the opening of the card receiving area. In one example, the opening to the card receiving area is generally co-planar with a flange of the housing which support the shuffler on a surface. A shield may extend upwardly from the flange to at least partially shield the card dispensing area and/or card receiving area.

The housing may define a console area which may be raised. The console area may include one or more displays.

The controller is configured to receive input from a user and is configured to control the features of the shuffler, such as the movable wall, the card infeed mechanism, the card receiver and card ejector, and to display information on the display, such as in response to an operator's input(s).

Further objects, features, and advantages of the present disclosure over the prior art will become apparent from the detailed description of the drawings which follows, when considered with the attached FIGS.

DETAILED DESCRIPTION

Figure 1:
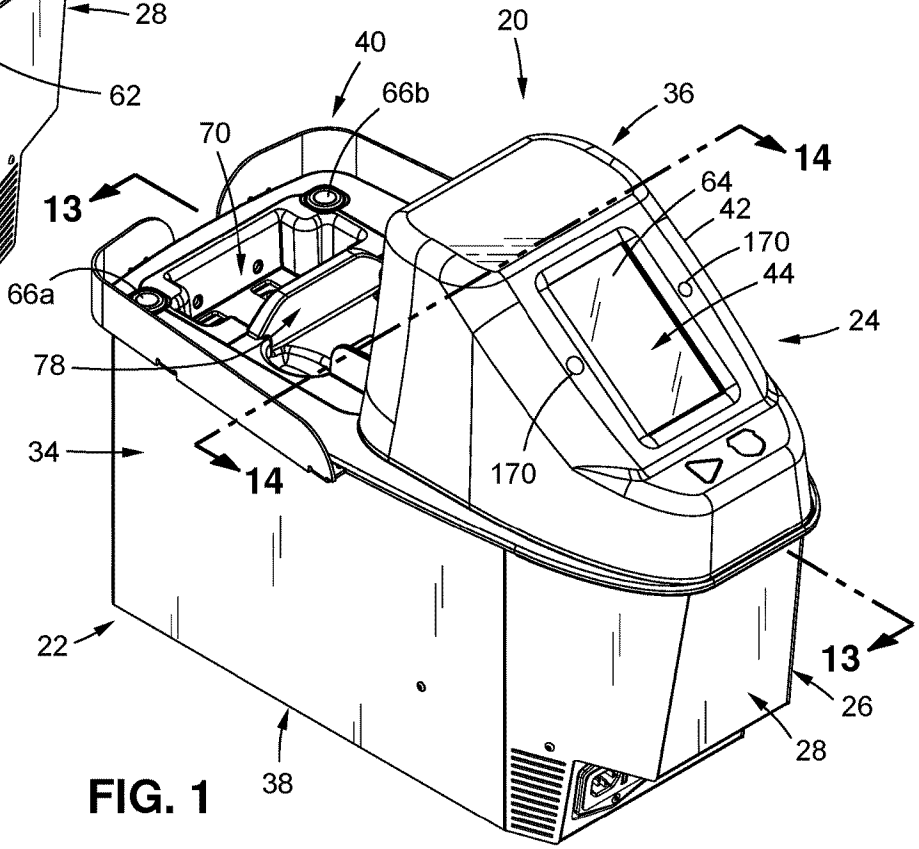
FIG. 1 is a front perspective view of a shuffler in accordance with examples of the subject disclosure.

In the following description, numerous specific details are set forth in order to provide a more thorough description of the present disclosure. It will be apparent, however, to one skilled in the art, that the present disclosure may be practiced without these specific details. In other instances, well-known features have not been described in detail so as not to obscure the disclosure.

Aspects of the disclosure comprise methods and devices for shuffling cards, and more preferably for forming one or more sets or hands of shuffled cards.

One example of a card shuffler of the disclosure will be described first with reference to FIGS. 1-7. As illustrated, a shuffler 20 of the disclosure comprises a housing 22 which contains, supports or otherwise defines one or more features of the shuffler 20. As illustrated, the housing 22 generally has an upper portion 24 and a lower portion 26. As further illustrated, the shuffler 20 has a front or first end 28, a rear or second end 30, a first side 32, a second side 34, a top 36 which is defined by the upper portion 24 of the housing 22 and a bottom 38 which is defined by the lower portion 26 of the housing 22. In the illustrated example, the housing 22 has a length along a line extending through the front or first end 28 and the rear or second end 30, and width along a line extending through the first and second sides 32,34, wherein the length is greater than the width.

Figure 7:
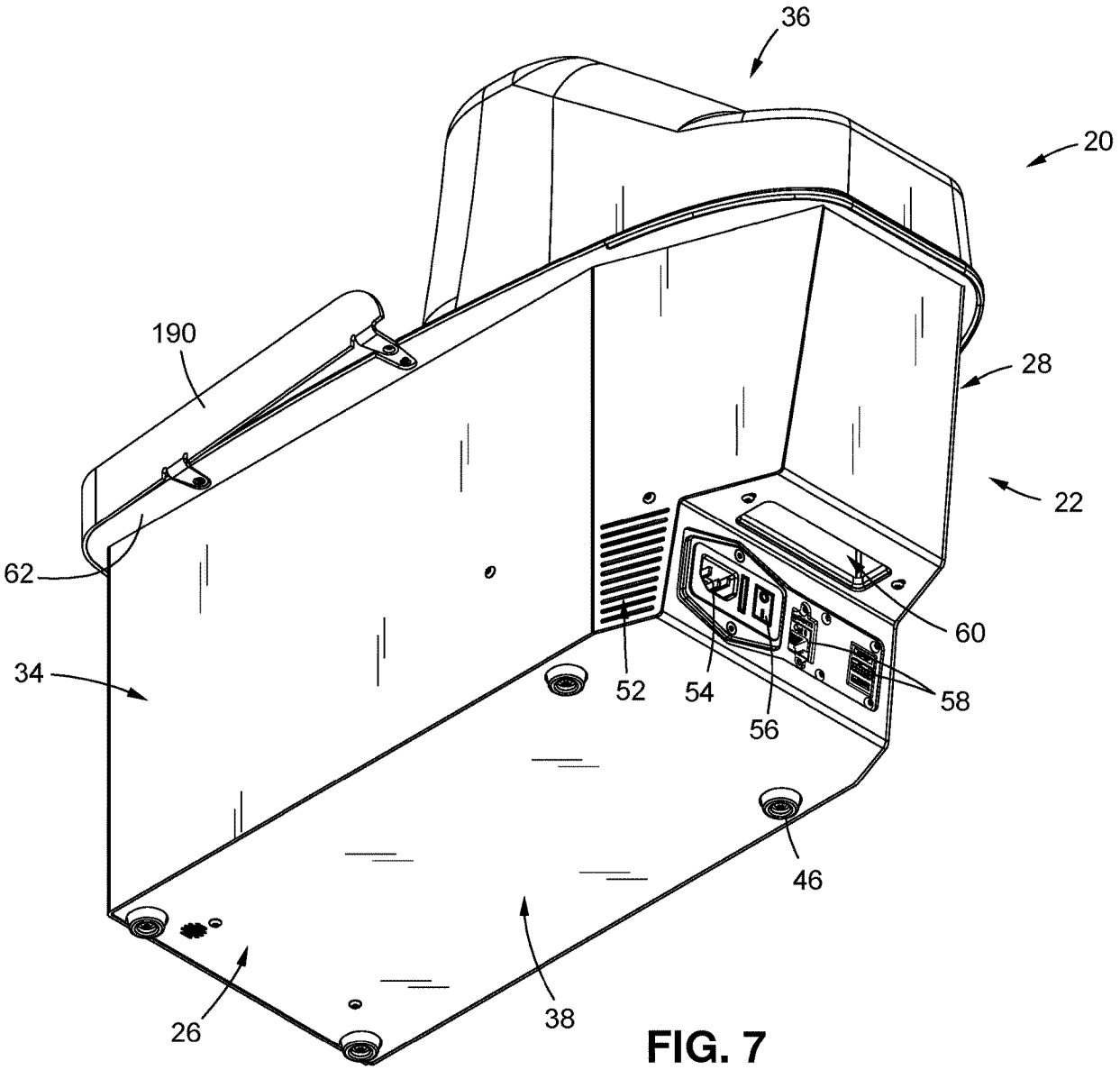
FIG. 7 is a perspective rear view of the shuffler illustrated in FIG. 1.

In certain examples, the lower portion 26 of the housing 22 comprises a generally closed space or enclosure for various components of the shuffler 20. The lower portion 26 may, as illustrated in FIG. 7, have a base portion that generally defines the bottom 38 of the shuffler 20, and then an upwardly extending wall that defines a portion of each side 32,34 and the front 28 and rear 30 of the shuffler 20. The upper portion 24 is positioned above the lower portion 26 of the housing 22. In certain examples, as better illustrated in FIGS. 1 and 2, the upper portion 24 defines a card receiving and dispensing area 40 and a raised containment area or console 42 which also defines or supports a control panel 44.

As illustrated in FIG. 7, the bottom 38 of the shuffler 20 may be generally planar. In certain examples, one or more feet 46 may extend downwardly therefrom, such as to support the shuffler 20 when it rests on a surface.

Figure 6:
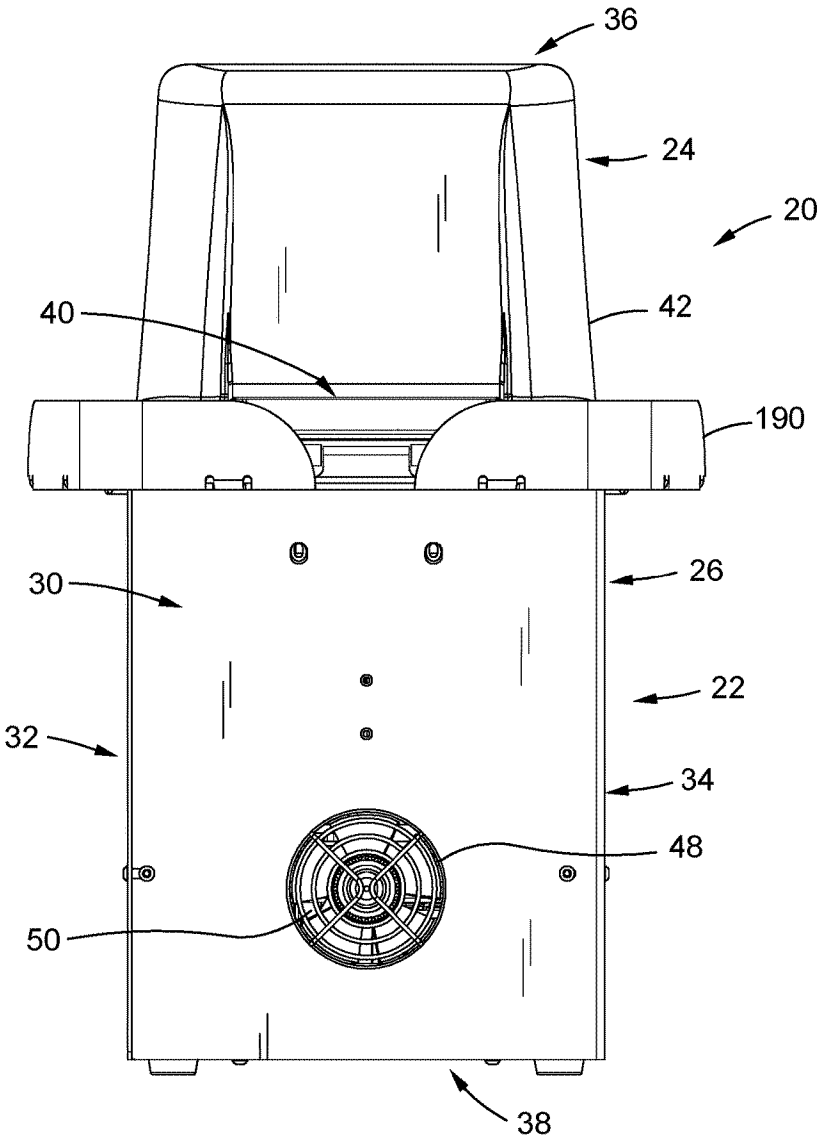
FIG. 6 is a rear plan view of the shuffler illustrated in FIG. 1.

Referring to FIG. 6, In certain examples, the rear 30 of the shuffler 20 may be defined in part by the wall of the lower portion 26 of the housing 22. As illustrated, one or more intake vents 48 may be located at the rear 30 of the shuffler 20. An electrically powered and motor driven fan 50 may be used to draw air through the intake vent 48 into the interior of the shuffler 20.

Figure 3:
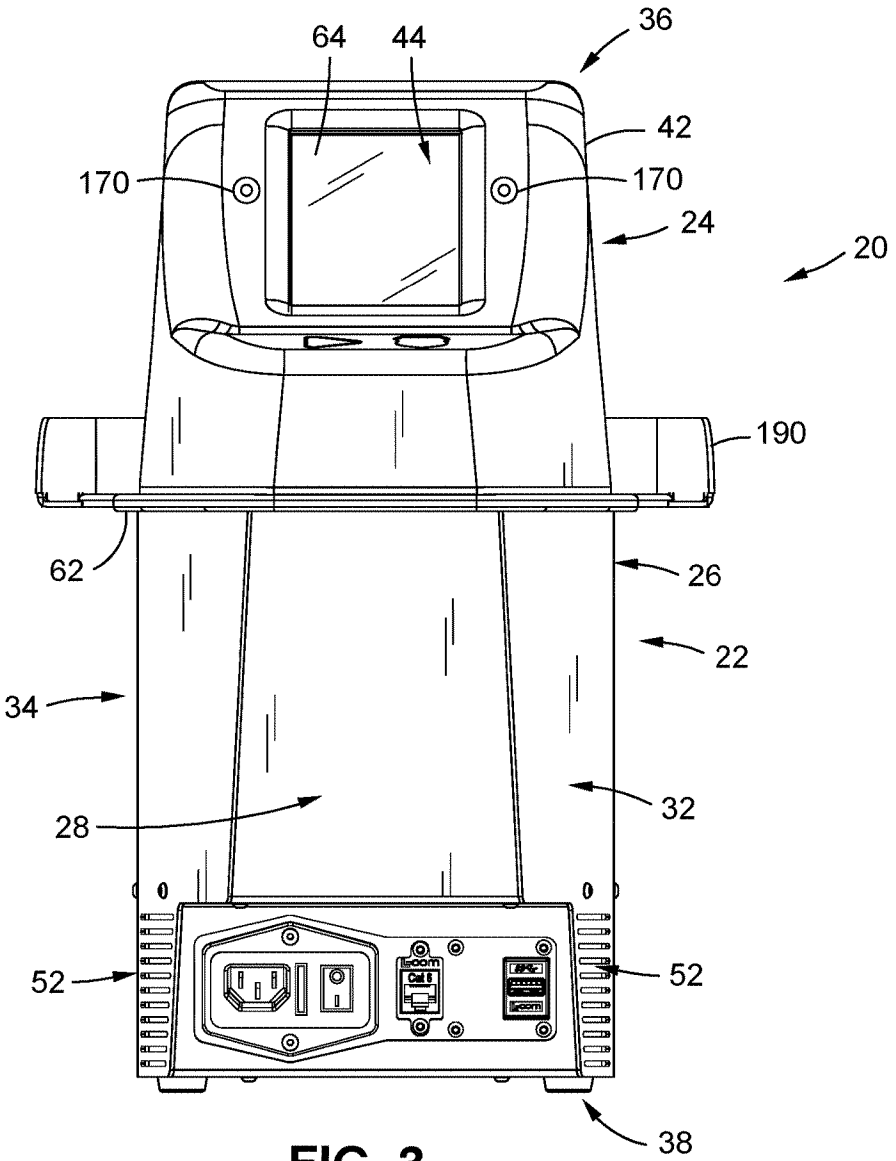
FIG. 3 is a front plan view of the shuffler illustrated in FIG. 1.

Referring to FIGS. 3 and 7, one or more air exhaust vents 52 may be provided, such as by being located at the front 28 of the shuffler 20, such as in the lower portion 26 of the housing 22. Air that is drawn into the interior of the shuffler 20 (via the intake vent 48) may be exhausted via these exhaust vents 52. In certain examples, one or more interfaces are provided, such as located at the front 28 of the shuffler 20. As illustrated, these interfaces may comprise a power cable port 54 (such as defining a male power coupler for receiving the female end of a power cord), a power switch 56 for turning power on and off to the unit, and one or more communication interfaces 58. Such communication interfaces 58 might comprise one or more of a CAT 6, CAT 5/5e, USB, Firewire, or other communication ports, such as for receiving an associated communication cable.

In certain examples, as illustrated in FIG. 7, the lower portion 26 of the housing 22 may define an inset 60. This inset 60 may be configured, along with an adjacent portion of the housing 22, to form a handle. This handle may be used, for example, by an installer to pick up the shuffler 20, such as during transport and/or installation.

As illustrated in FIG. 7, the lower portion 26 of the housing 22 may define an outwardly extending flange 62, such as an intersection of the lower portion 26 with the upper portion 24 of the housing. The flange 62 may extend around the entire shuffler 20, or might be in one or more locations. As described in more detail below, the flange 62 may define a mounting location for one or more features of the shuffler 20, and may also serve as a supporting surface or stop for mounting the shuffler 20. For example, when the shuffler 20 is mounted to a gaming table, the shuffler 20 may be lowered into an opening in a supporting surface of the table, with the lower portion 26 of the housing 22 located under the gaming table surface and the flange 62 resting upon the surface and thus generally supporting the shuffler 20.

Referring to FIGS. 1-4, the raised or console area 42 of the upper portion 24 of the housing 22 extends upwardly at the front 28 of the shuffler 20. As indicated, a control panel 44 may be associated with the raised area 42. In certain examples, the control panel 44 generally faces towards the front 28 of the shuffler 20. The control panel 44 may comprise one or more input and output devices, such as one or more video displays 64 for displaying information, and at least one indicator 170 (as illustrated, two indicators might be provided). Each indicator 170 might comprise, for example, an LED light.

The raised area 42 may be defined by a body or cover that is connected to the lower portion 26 of the housing 22. One or more features of the control panel 44 may be connected to that body or cover. As detailed below, the body or cover may extend over internal features of the shuffler 20, such as a moving card receiver, a card ejector and the like.

The card receiving and dispensing area 40 is located rearwardly of the raised area 42, between the raised area 42 and the rear 30 of the shuffler. In certain examples, the card area 40 comprises a card receiving or infeed area 70 and a card dispensing area 72. The card receiving area 70 may comprise a recessed or depressed area in the upper portion 24 of the housing 22. In certain examples, the card receiving area 70 is card shaped, e.g. generally rectangular in shape, such as having first and second opposing side walls and first and second opposing end walls which extend between the side walls, a generally open top and a generally closed bottom. The length of the side walls and the width of the end walls are configured to define a card receiving area 70 which is slightly larger in dimension than the cards of a standard card deck. As illustrated, the card receiving area 70 may be oriented so that its longer sides (corresponding to the height of a playing card from a top end to a bottom end thereof) extend generally parallel to a line through the sides 32,34 of the shuffler 20, and so that its shorter sides (corresponding to the width of a playing card from side to side thereof) extend generally parallel to a line through the front 28 and rear 30 of the shuffler 20. As described below, in this orientation, the card receiving area 70 is configured to receive cards and deliver them into the shuffler 20 in a "sideways" orientation. The sidewalls and end walls may extend generally vertically upward from the bottom (at 90 degrees thereto, or in other examples, at angles slightly greater than 90 degrees, whereby the walls generally tilt slightly outward such that a dimension of the open top of the card receiving area 70 is larger than the dimension of the bottom, whereby the slight slope in the walls tends to guide cards placed in the card receiving area 70 towards the bottom thereof).

Figure 4:
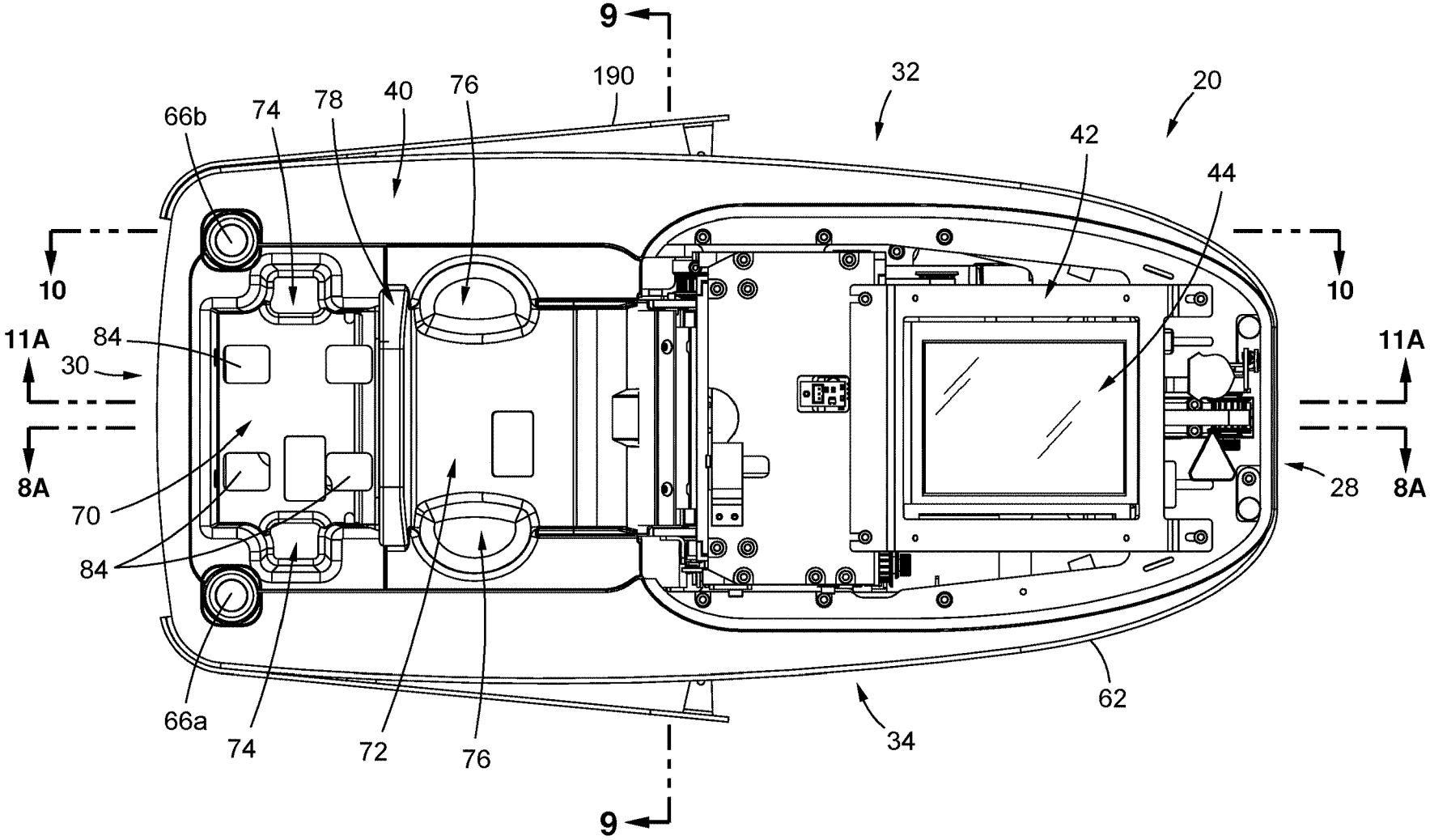
FIG. 4 is a top plan view of the shuffler illustrated in FIG. 1, with portions of a top cover thereof removed.
Figure 10:
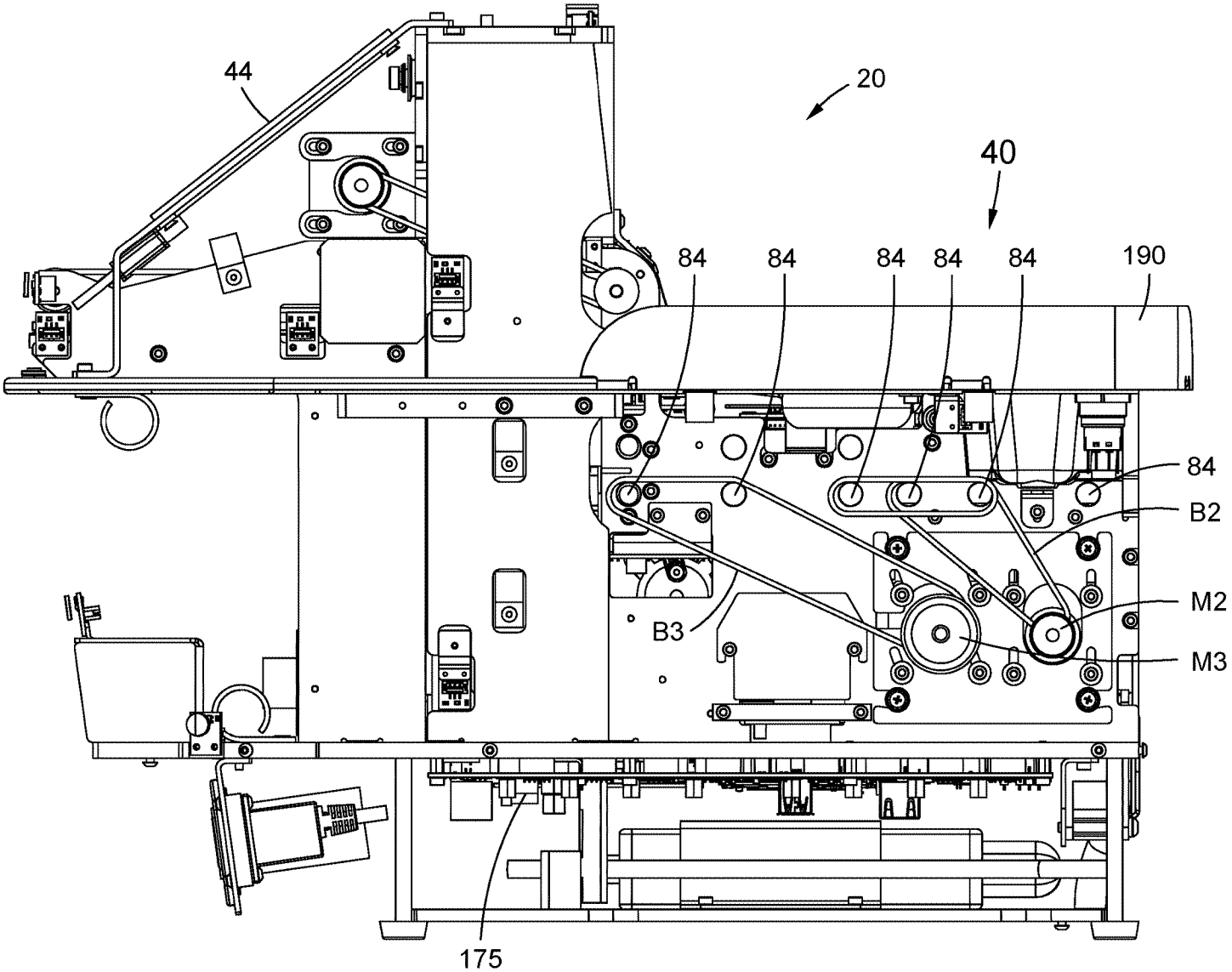
FIG. 10 is a second longitudinal cross-sectional side view of the shuffler illustrated in FIG. 4 taken in the direction of line 10/10 therein and with portions of a housing thereof not illustrated.
Figure 13:
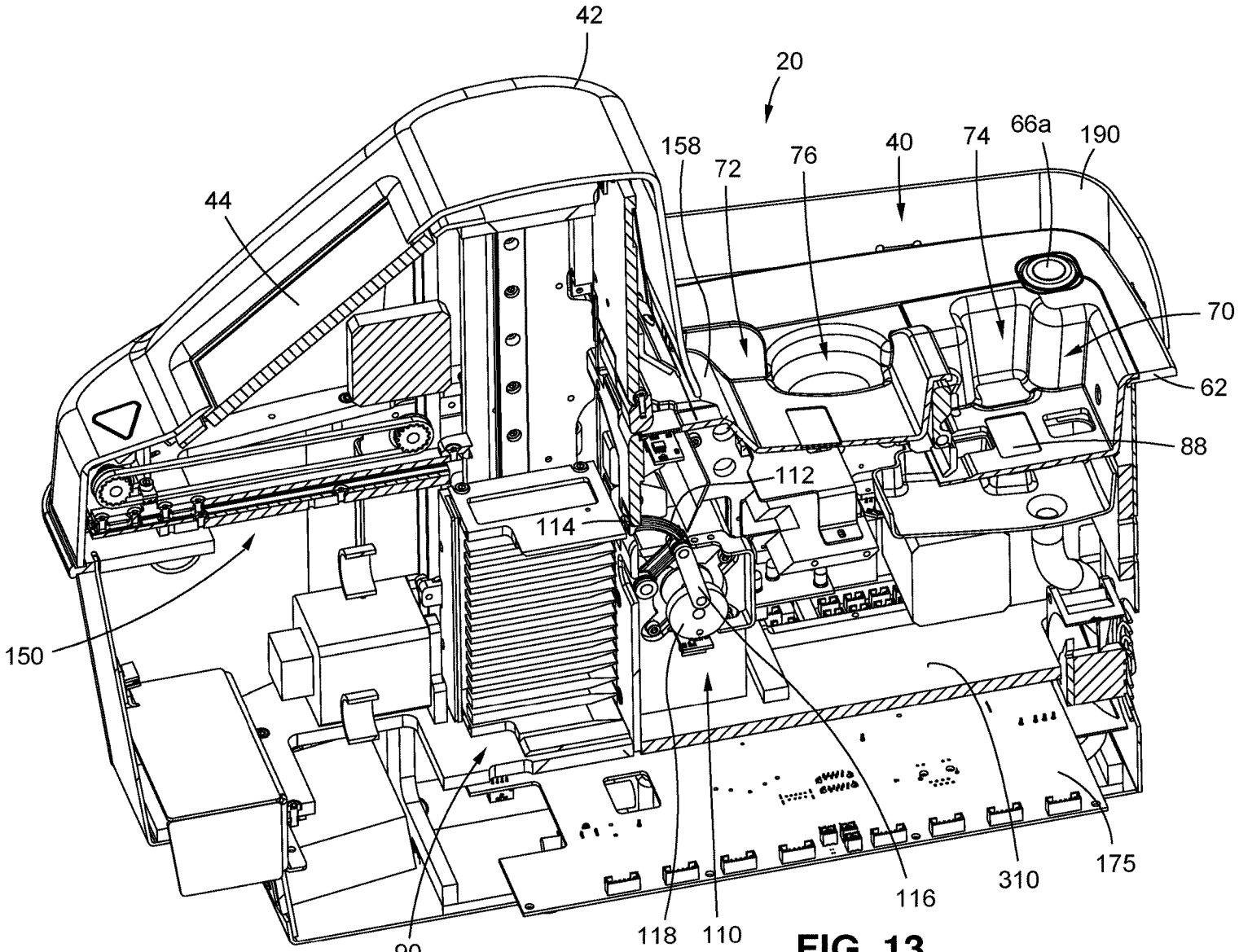
FIG. 13 is a longitudinal perspective cross-sectional view of the shuffler illustrated in FIG. 1 taken in the direction of line 13/13 therein.

In certain examples, as best illustrated in FIG. 4, a finger recess 74 is located at a top and a bottom of (or in other words, at or in the end walls of) the card receiving area 70. The finger recesses 74 are sized to receive one or more fingers of a user who is gripping the top and bottom ends of one or more stacked cards that are being placed into or being removed from the card receiving area 70. In certain examples, as best illustrated in FIGS. 10 and 13, the finger recesses 74 may extend downwardly below the card supporting bottom of the card receiving area 70 (e.g. below the plane that the bottom card lies in when cards are located in the card receiving area 70). As illustrated, this configuration may be facilitated by the finger recesses 74 being located at both ends of the card receiving area 70 and outside (laterally) of card feed rollers (described below). A particular advantage to this configuration is that in order to securely grip a set of cards a user may place their fingers so that they extend beyond or below the bottom card of a set of cards. In the configuration described, the user's fingers are then accommodated in this position as the cards are being placed into (or removed from) the card receiving area 70.

In the illustrated example, the card dispensing area 72 is located between the card receiving area 70 and the raised area 42 of the upper portion 24 of the housing 22, whereby the card receiving area 70 is located at the rear 30 of the housing, the card dispensing area 72 is located adjacent to the card receiving area 70 towards the front 28, and the raised area 42 is located adjacent to the card dispensing area 72 towards the front 28, generally along a longitudinal line through the housing 22 through the front 28 and rear 30. In this manner, as described in more detail below, the card dispensing area 72 can receive cards which are ejected or dispensed outwardly from the shuffler 20 at the raised area 42 thereof.

Like the card receiving area 70, the card dispensing area 72 comprises a recessed or depressed area of the housing 22. The card dispensing area 72 may similarly comprise a generally rectangular-shaped area which is sized to receive one or more cards in a "sideways" orientation (e.g. with the cards oriented such that a line running through them lengthwise from top to bottom extends generally perpendicular to a line running through the shuffler 20 from the front 28 to the rear 30). The card dispensing area 72 may also comprise one or more finger recesses 76, such as at a location corresponding to a top and bottom or the ends of the card dispensing area 72, and thus the top and bottom of cards located therein.

Figures 8A, 8B:
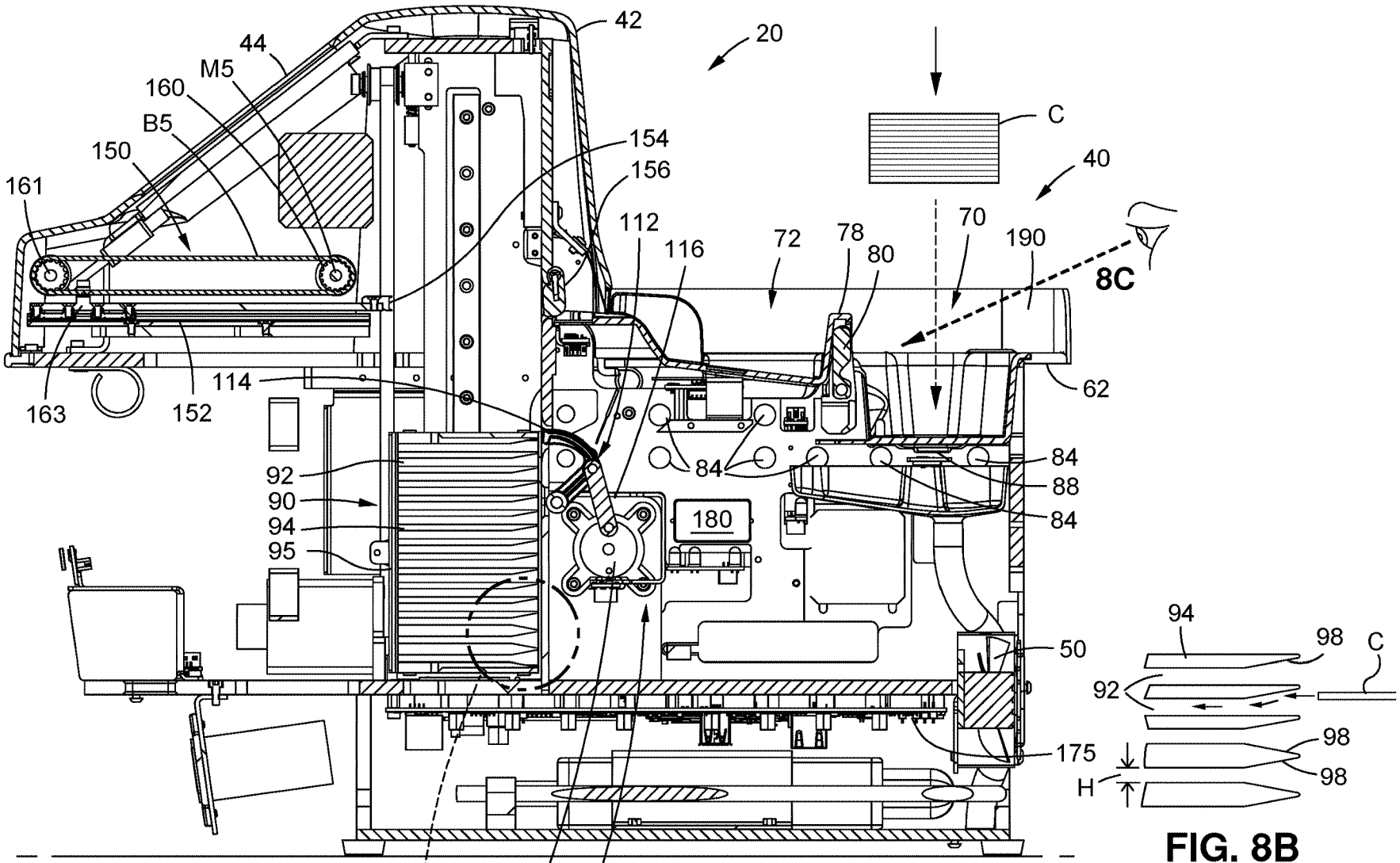
FIG. 8A longitudinal cross-sectional side view of the shuffler illustrated in FIG. 4 taken in the direction of line 8A/8A therein and with portions of a housing thereof not illustrated.
FIG. 8B is an enlarged view of the indicated portion of FIG. 8A.

As best illustrated in FIG. 8A, in certain examples, a top of the card receiving area 70 is generally coplanar with (e.g. at approximately the same elevation as) the top of the lower portion 26 of the housing 22, and thus the flange 62 thereof (thus, when the flange 62 is positioned on a supporting surface, the top of the card receiving area 70 is positioned above the supporting surface). On the other hand, a top of the card dispensing area 72 is generally higher than the top of the card receiving area 70. As illustrated, the top of the card dispensing area 72 is generally defined by a card ramp 158 and the top of a divider 78 (both described in more detail below), which are positioned higher than the flange 62 and the top of the card receiving area 70 (whereby a top of the card dispensing area 72 is in a plane which is higher than a plane containing the top of the card receiving area 70).

Both the card receiving area 70 and card dispensing area 72 extend downwardly below the flange 62, and thus downwardly into the lower portion 26 of the housing 22. When the flange 62 is resting upon a surface of a gaming table, this means that at least the bottom of the card receiving area 70 and the bottom of the card dispensing area 72 are generally located below the table surface.

As illustrated, the card receiving area 70 and the card dispensing area 72 are separated, such as by an upwardly extending divider 78. In certain examples, the divider 78 effectively forms one of the sidewalls of the card receiving area 70 and one of the sides of the card dispensing area 72. In certain examples, the divider 78 extends upwardly above the card receiving area 70 and the card dispensing area 72, such as to a height where a top thereof is located above the flange 62 and thus above a gaming table surface when the shuffler 20 is mounted therein. In certain examples, the divider 78 not only serves to divide the card receiving area 70 from the card dispensing area 72, but also accommodates a moveable side wall 80 which is associated with the card receiving area 70, and serves as a stop for cards which are ejected onto and sliding down the card ramp 158 of the card dispensing area 72.

In one example, the bottom of the card dispensing area 72 slopes, such as downwardly in the direction of the card receiving area 70. As described below, this allows cards which are ejected from the shuffler 70 and sliding down the card ramp 158 to be directed towards the divider 78 and position where they are easily retrieved for dealing.

Additional details of the shuffler 20, including the operation thereof, will now be described, primarily with reference to FIGS. 8A-14.

Card Infeed

In certain examples, the shuffler 20 includes a card infeed mechanism. The card infeed mechanism is configured to retrieve or take cards from the card receiving area 70 and deliver them to a card shuffler mechanism (which is described below and may comprise a card receiver) in the shuffler 20. In certain examples, the card infeed mechanism thus comprises means for moving cards from the card receiving area 70 to the card shuffling mechanism.

As described in more detail below, a user of the shuffler 20 places one or more cards, such as one or more decks of cards, into the card receiving area 70. In certain examples, the card infeed mechanism is configured to grab or retrieve cards from the bottom of the stack or deck of cards that is located in the card receiving area 70.

In certain examples, one wall, or at least a portion thereof, which defines the card receiving area 70 is movable. The wall may comprise a moveable side wall 80 which comprises a generally planar body that is movable from a first position to a second position. The first position may comprise a raised or retracted position, such as where the moveable side wall 80 is generally vertically extending (and generally extends approximately 90 degrees relative to the bottom of the card receiving area 70 and generally parallel to the other side wall and the end walls). In the first position, the movable side wall 80, or at least a face or surface thereof, defines part of a peripheral boundary of the card receiving area for cards located therein. The second position may comprise a tilted or extended position where the moveable side wall 80 extends into the card receiving area 70. In this position the moveable side wall 80 may extend at an angle, such as to a horizontal or other substantially non-vertical position. In the second position, the movable side wall 80 is configured to engage one or more cards in the card receiving area 70, such as by contacting a top card in the card receiving area 70 (where there may be one or more cards in the card receiving area 70).

Figure 8C:
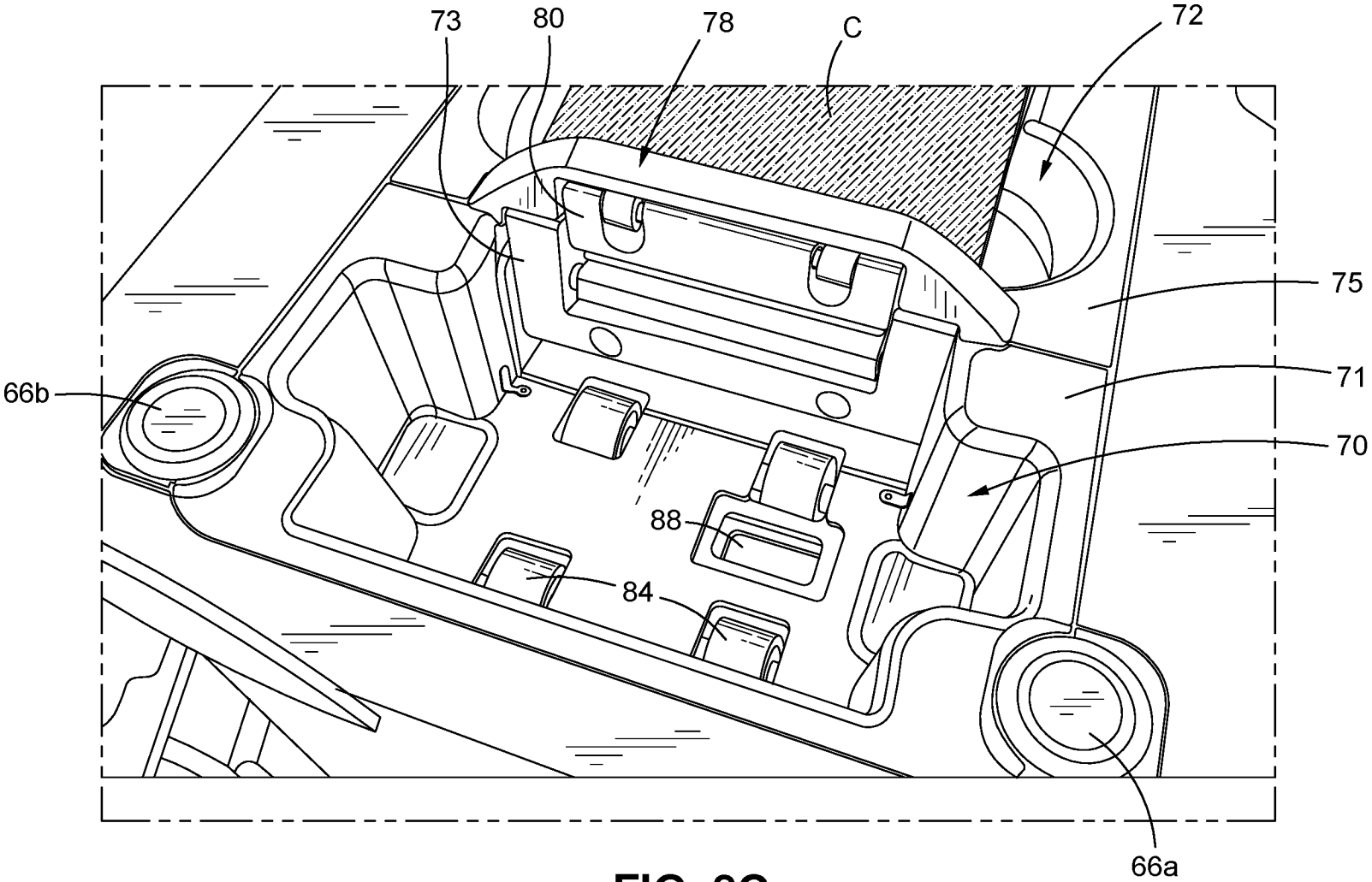
FIG. 8C illustrates the portion of FIG. 8A as viewed from the perspective indicated in FIG. 8A.

As best illustrated in FIG. 8C, the card dispensing area 72 may be at least partially defined by a first tray 75. The first tray 75 may, for example, comprise a molded plastic body that is supported by frame elements (described in more detail below) of the shuffler 20 within the lower portion 26 of the housing 20. This first tray 75 may define at least part of the divider 78, such as a front wall or face thereof that faces the card dispensing area 72. Likewise, the card receiving area 70 may at least partially defined by a second tray 71. This second tray 71 may again comprise a molded plastic body that is supported by frame elements of the shuffler 20 (as illustrated, the second tray 71 may define one or more openings, such as for the rollers 84 and card sensor 88, described below). In one embodiment, the first tray 75 and the second tray 71 may be selectively disconnectable from the shuffler 20, such as to access components adjacent to the trays, such as for service.

In one example, the side of the second tray 71 at or facing the divider 78 is open. This side or wall of the card receiving area 70 (which essentially comprises the rear face of the divider 78) may be defined by a base support 73 and the moveable side wall 80. The base support 73 may comprise a supporting or mounting element, such as a metal plate that is associated with the frame structure in the housing 20. The movable side wall 80 may be movably mounted to the base support 73 and thus be movable relative to the base support 73 and the divider 78, such as by pins (such as located at opposing ends of the movable side wall 80 near a bottom portion thereof, whereby the movable side wall 80 is essentially 'hinged" so that it rotates about the bottom thereof relative to the base support 73). The moveable side wall 80 may thus rotate relative to the base support 73, such as via or about the pins, where as illustrated, the pivot location may be raised from a bottom of the card receiving area 70. When the moveable side wall 80 is moved to its vertical position, it fits within or retracts into a recessed portion of the divider 78, whereby a face of the moveable side wall 80 becomes one side or boundary of the card receiving area 70 (which thus constrains cards located therein), as best illustrated in FIG. 8C.

Figure 2:
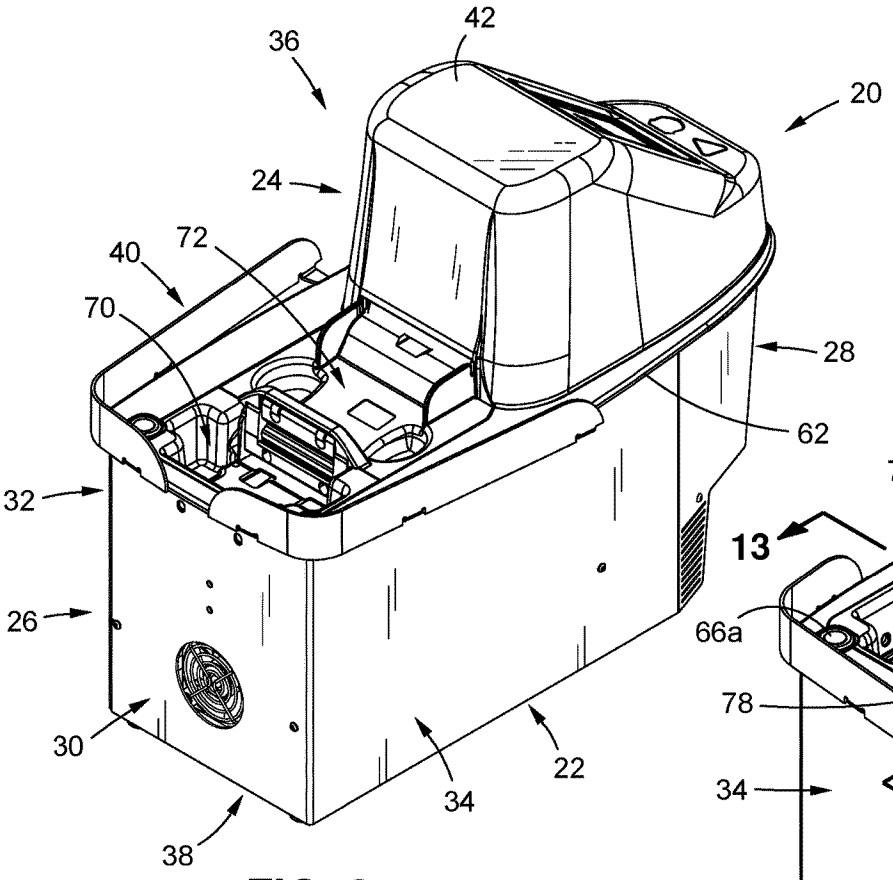
FIG. 2 is a rear perspective view of the shuffler illustrated in FIG. 1.

Still referring to FIGS. 2 and 8A, the moveable side wall 80 may have a length from its pivot point to its opposing or free end which is relatively short (and preferably, of a length that allows the movable side wall 80 to fit within the divider 78 when the movable side wall is in its vertical position). For example, the length of the movable side wall 80 may be such that when it is tilted into the card receiving area 70, it only extends about ⅓ of the way across the card receiving area 70 towards the other side (when the movable side wall 80 is tilted to a generally horizontal position), thus only engaging a portion of one side of the top card in the card receiving area 70. In this regard, in one example, the movable side wall 80 comprises just a portion of one of the sidewalls of the card receiving area 70. The exact size of the movable side wall 80 might vary.

Figure 11A:
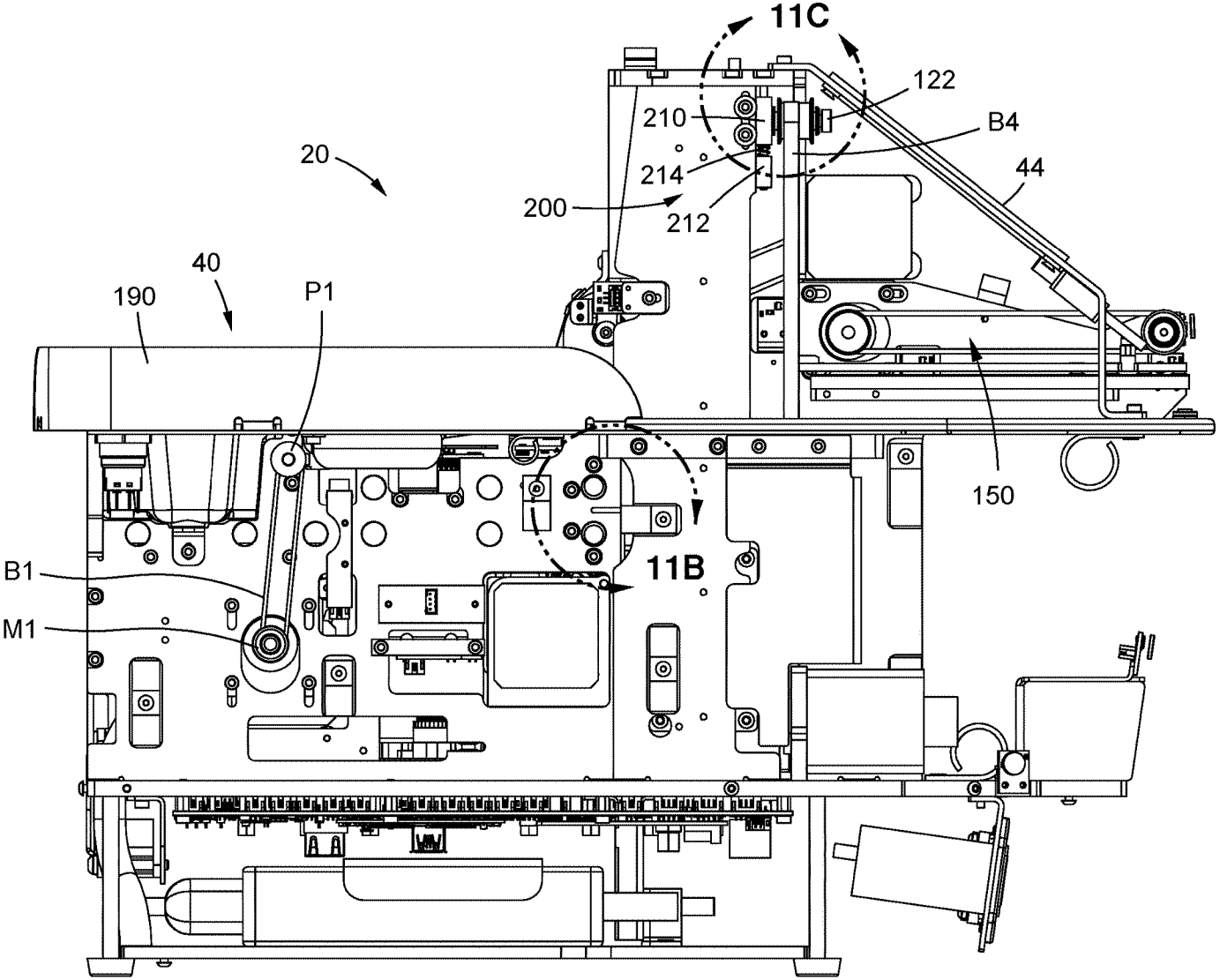
FIG. 11A is a longitudinal cross-sectional side view of the shuffler illustrated in FIG. 4 taken in the direction of line 11A/11A therein and with portions of a housing thereof not illustrated.
Figure 11C:
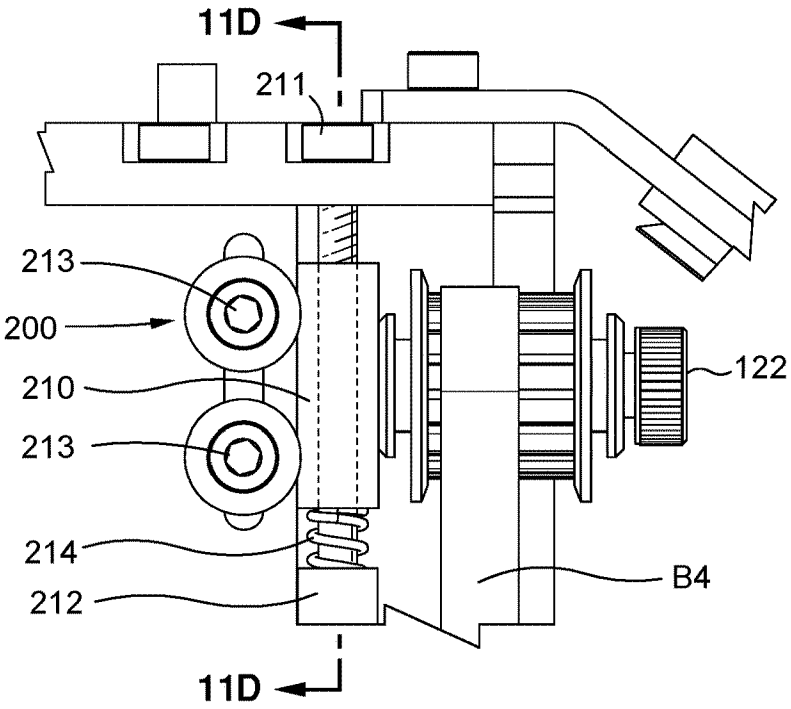
FIG. 11C is an enlarged view of the indicated portion of FIG. 11A.

Means are also provided for moving the moveable side wall 80, such as by a motor M1 which drives a pulley P1 which is associated with the moveable side wall 80, via a belt B1, as illustrated in FIG. 11A. As described in more detail below, operation of the moveable side wall 80 may be controlled by a controller 175 (see FIG. 15), including based upon input from one or more sensors. In particular, in certain examples, at least one sensor 88 may be provided for sensing one or more cards in the card receiving area 70. As illustrated in FIGS. 8A and 13, the card sensor 88 may be located at a bottom of the card receiving area 70, such as where the sensor is located under the bottom of the card receiving area 70 and where the bottom of the card receiving area includes a window or opening. The card sensor 88 may comprise, for example, an IR or other optical sensor which has an emitter which sends a beam of light outwardly through the opening or window and into the card receiving area 70. If one or more cards are located in the card receiving area 70, the light will be reflected back and be detected by a detector of the sensor 88 (and which sensor does not detect the light when no cards are located in the receiving area 70).

As indicated, the operation of the moveable side wall 80 may be controlled by a controller 175. The controller 175 may control the motor M1, including based upon information obtained by the controller from the card sensor 88. In certain examples, the motor M1 may be configured to drive the moveable side wall 80 with a relatively constant torque (such as by setting the motor to operate at a constant velocity in order to approximate constant torque), thus ensuring constant pressure on the cards in the card receiving area 70.

In certain examples, the controller 175 is, after a short time delay from when the card sensor 88 detects cards in the card area, configured to move the moveable side wall 80 so that it tilts and engages the top of the cards in the card receiving area 70. The moveable side wall 80 is moved back to its vertical position and does not move back into the card area when no cards remain in the card receiving area 70 (as determined by the sensor 88).

In some instances, a user may inadvertently place a second set or deck of cards into the card receiving area 70 when a first set or deck is already located in the receiving area 70 under the moveable side wall 80. In certain examples, the controller 175 is configured to receive information, such as from a card reader/sensor, which allows the controller to determine the number of cards which have been processed by the shuffler. Thus, when the controller 175 determines, based upon a card count, that all cards of a deck have been processed, if the card sensor 88 detects that cards are located in the card receiving area 70, the controller 175 can determine that cards were inadvertently placed into the card receiving area 70 on top of the moveable side wall 80. In such instance, the controller 175 is preferably configured to output an error message to the user that instructs the user to remove the cards. Once the cards are removed (as detected by the card sensor 88), the controller 175 can retract the moveable side wall 80 so that the user can place the cards back into the card receiving area for processing (at which time the moveable side wall 80 is again lowered into position against the top of that next set of cards). The controller 175 will then begin processing (shuffling) that next set of cards, such as instructed by the user.

The card infeed mechanism also comprises means for moving the cards. In certain examples, as best illustrated in FIG. 4, one or more rollers 84 are associated with the card receiving area 70, such as by being positioned at the bottom of the card receiving area 70. One or more, and preferably at least two, of those rollers 84 are preferably driven rollers (e.g. such as driven by a motor M2 via one or more belts B2, as illustrated in FIG. 10). Additional rollers may be provided, such as idler top rollers (not shown). In this manner, one or more of the rollers 84 which are in contact with the bottom-most card in the card receiving area 70, are configured to draw or drive that card from the card receiving area 70 into the interior of the shuffler 20, as best illustrated in FIG. 8A. In certain examples, cards are driven or moved from the card receiving area 70 through a slot in the housing 22 into the interior of the shuffler. In this manner, individual cards are moved, one at a time (e.g. sequentially as they are removed from the bottom of the card receiving area 70), from the card receiving area 70 into the shuffler 20.

As illustrated in FIGS. 8A and 10, one or more additional rollers 84 or other feeding/moving devices are used to move the cards to the card shuffler. For example, as illustrated, multiple pairs of rollers 84 (one or more of which may be driven or idler rollers) may be used to move each card generally horizontally from the card receiving area 70 through the shuffler 20 linearly to the card shuffler.

As illustrated in FIG. 10, one or more motors M3 may be used to drive one or more of the rollers, such as the driven (as opposed to idler). The one or more motors M3 may drive the rollers directly or indirectly, such as by rotating one or more belts B3 (which belts may be driven by pulley which is driven by the motor and which drives a pulley which is associated with the driven roller, such as where the pulley is mounted on an axle of the roller). Of course various drive mechanisms might be used to drive the rollers (including direct drives, gear drives, etc.). As described below, the motors may be controlled by the controller 175, such to selectively drive the rollers.

Shuffler Mechanism

In certain examples, cards which are delivered from the card receiving area 70 are delivered to a card handler or shuffler mechanism. The card handler is preferably configured to shuffle, e.g. randomly arrange, the cards, and more preferably, randomly arrange the cards into one or more groups, sets or hands (as used herein the term "hand" may mean a complete set of cards which is dealt or provided to a player or dealer, but may also comprise other groups of cards, such as sets of community cards, replacement cards for discarded cards and the like).

Figure 9:
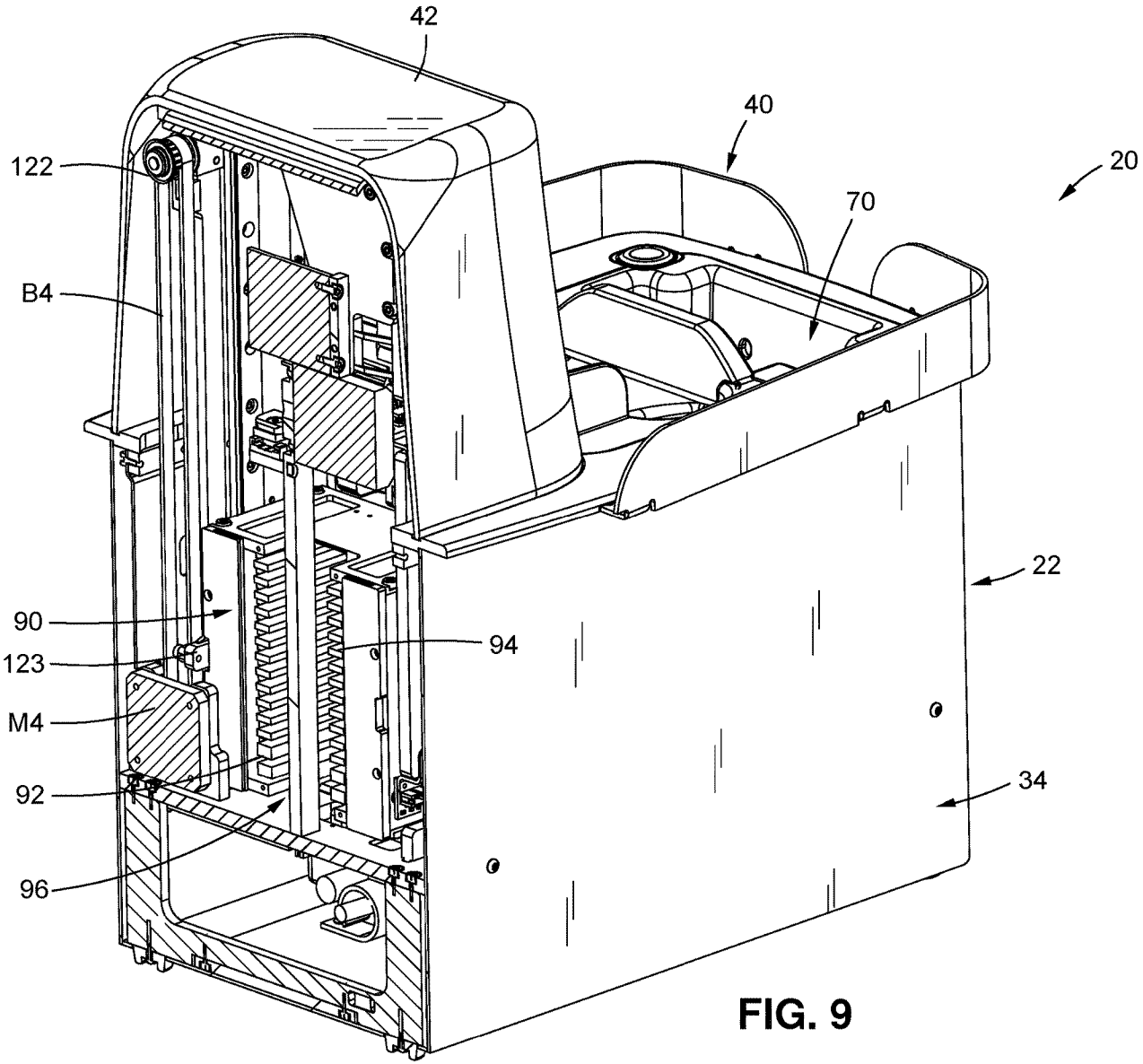
FIG. 9 is a transverse cross-sectional view of the shuffler illustrated in FIG. 4 taken in the direction of line 9/9 therein.

In certain examples, as best illustrated in FIGS. 8A and 9, the card handler comprises a movable card receiver 90 having a plurality of card slots or pockets 92, and means for selectively moving the card receiver 90 in order to direct cards into particular pockets 92.

As illustrated, the card receiver 90 comprises a plurality of dividers 94. The dividers 94 are separated from one another, thus defining the plurality of card slots or pockets 92. In one example, the dividers 94 are arranged or stacked vertically, thus defining a plurality of vertically spaced pockets 92. The card receiver 90 may comprise a top or a top divider, a bottom or a bottom divider and a plurality of intermediate dividers therebetween.

For reasons described in more detail below, and as best illustrated in FIG. 9, the card receiver 90 may comprise a first set of dividers and a second set of dividers which are separated by a slot or channel 96, or where the dividers otherwise simply define such a channel 96. This slot or channel 96 causes the card receiver 90 to have a reduced weight as compared to one where the dividers 94 do not include such a slot. In addition, as described below, this channel 96 facilitates passage of a card pusher 152 into the card pockets 92 in order to eject the cards.

As illustrated in FIGS. 8A and B, each card divider 94 preferably defines a generally planar card supporting portion, such as at top thereof, and at least one card receiving ramp 98. The card ramp 98 comprises a sloping surface which leads from a front of the card divider 94 towards the rear thereof at which the generally planar card supporting portion is defined.

As described below, certain card dividers 94 may define only a "top" card ramp 98 (e.g. one associated with the top of the divider), while others define top and bottom card ramps 98 (e.g. one associated with the top of the divider and one associated with the bottom of the divider). In certain examples, each card divider 94 that has only a top card ramp may have a nominal thickness (a thickness or height except at the ramped area) of about 0.11 inches. When a thickness of each playing card which is being shuffled by the shuffler 20 is about 0.011 inches, this causes those dividers 94 to have a thickness of about 10 (and preferably more than 10) times the thickness of each card. The card dividers 94 which have top and bottom ramps may have a thickness of about and 0.2 inches. When a thickness of each playing card which is being shuffled by the shuffler 20 is about 0.011 inches, this causes those dividers 94 to have a thickness of about 20 times the thickness of each card.

A height of each card ramp is about 0.08 to 0.09 inches, such that a ratio of the height of each card ramp to the thickness of the cards is about 7-8 (when the thickness of the cards is about 0.011 inches).

The card dividers 94 are separated from one another a distance H of about 0.125-0.145 inches (between a top surface of one divider and the bottom surface of an adjacent divider), whereby a ratio of the height of each pocket 92 to the thickness of each card is about 11-13 (when the cards have a thickness of about 0.011 inches).

In certain examples, each card ramp 98 slopes at an angle of around 10-11 degrees. When considering the thickness of the card divider 94 noted above, the ramps thus extend rearwardly from the front of each card divider 94 towards the rear thereof a distance of about 0.466 inches.

The term "about", with respect to the noted dimensions, in one example comprises a variable amount that accounts for manufacturing tolerances and variations and is an amount which does not affect the intended operation of the feature. In one example, the term may comprise an amount such as +/−10% of the indicated dimension.

In certain examples, the card dividers 94 are constructed from metal, such as aluminum, or other material which has a low coefficient of friction, a low wear rate and is not subject to bending or warping (such as plastic), as such characteristics are important in ensuring that the card dividers 94 work properly as described below (including by directing incoming cards into the associated card pockets 92).

As indicated above, certain card dividers 94 define only a top card ramp 98 (e.g. one associated with the top of the divider), while others define top and bottom card ramps 98 (e.g. one associated with the top of the divider and one associated with the bottom of the divider). In certain examples, one or more card pockets 92, those of a first type, are defined between the upper card ramp 98 on one divider 94 and the lower card ramp on another divider. Other card pockets 92, those of a second type, are defined between the lower card ramp 98 on one divider 94 and the generally planar top surface of another divider. In one example, the top divider 94 may only define a bottom card ramp and the bottom divider 94 may only define a top card ramp.

In the example illustrated, the card receiver 90 defines fifteen (15) card pockets 92. In certain examples, twelve (12) of those card pockets 92 are pockets of the first type, and they are located at the top of the card receiver 90. The remaining three (3) card pockets 92, those of the second type, are located at the bottom.

In certain examples, card pockets 92 of the first type are configured to receive cards in a first configuration. In certain examples, this comprises "top stacking" of cards, wherein when more than one card is placed in the pocket, cards are stacked on top of one another (e.g. a first card is delivered to the pocket and then a second card is delivered to the pocket on top of the first card). In certain examples, the card receiver 90 is moved so that the card divider 94 which is above the card pocket 92 to which the card is to be delivered is aligned with the card to be delivered, as illustrated in FIG. 8A. An incoming card is moved horizontally so that it hits the card ramp 98 on the bottom of the divider 94, as best illustrated in FIG. 8B. If the card being delivered to that card pocket 92 is the first card being delivered to that pocket, that card then falls to the bottom of the pocket 92 (e.g. onto the top of the divider below). If the card being delivered to that card pocket 92 is the second card being delivered to that pocket, that card impacts the ramp of the divider and then falls on top of the first card already in the pocket 92. The number of cards which are located in a "top stacking" pocket 92 may vary (such as depending upon the intended use of the cards, such as for discards, etc.).

In certain examples, card pockets 92 of the second type are configured to receive cards in a second configuration. In certain examples, this comprises "top and bottom stacking", wherein cards may be stacked from above or below (e.g. cards may be delivered so that they are stacked on top of the cards which are already in the pocket or are placed below the cards that are already in the pocket). In certain examples, if a card is to be delivered to the card pocket 92 from above, the card receiver 90 is moved so that the card divider 94 above the desired pocket 92 is aligned with the card and then the card is delivered in the same manner as described above. If, however, a card is to be delivered to the card pocket 92 from below, the card receiver 90 is moved so that the card divider 94 below the desired pocket 92 is aligned with the card. The card is then delivered, hitting the ramp 98 of the card divider 94 at the bottom of the pocket 92 and then being pressed inwardly under any existing cards in that pocket 92. Again, the number of cards which are placed into a "top and bottom stacking" pocket 92 may vary, such as based upon the intended use of the cards. In one example, the "top and bottom stacking" pockets 92 may be used for randomizing cards, such as for randomizing two cards relative to one another, but might also be used for larger numbers of discard cards, etc.

The total number of card pockets 92 and/or the number of card pockets of the first and second types might vary from the configuration described herein, such as depending upon the particular application (such as the particular game or games for which the shuffler 20 supplies cards). For example, the card receiver 90 might have more card pockets 90 of the second type than the first type. In addition, the size of the pockets 92 might vary in other applications, such as depending upon the total number of cards that might be desirably delivered to a particular pocket 90.

In certain examples, means are provided for retaining cards which are delivered to the pockets 92 in the pockets to which they are delivered. In particular, to prevent the cards which are being delivered to a pocket 92 from passing therethrough (towards the front of the shuffler in FIG. 8A), the card receiver 90 may include, as illustrated in FIG. 8A, a front wall 95, or the dividers 94 may include walls, stops or the like. In addition, the means may also comprise means for preventing a card that is being delivered into one of the card pockets 92 from rebounding back out of the pocket. In particular, the force of a card impacting the front wall or stop may cause the card to rebound and travel back through the pocket (in the direction of the rear of the shuffler 20). In certain examples, as best illustrated in FIGS. 8A and 13, a card stop 110 is provided for this purpose. In certain examples, the card stop 110 comprises an arm 112 or other body which is movably mounted, such as for pivoting movement, and has a stop portion 114. As illustrated, the arm 112 may be somewhat "L" shaped, having a first end which is pivotally mounted to the shuffler and a second end which comprises the stop 114.

Means are provided for moving the arm 112, such as from a retracted position (in which it does not block the card pocket 92 to which cards are being delivered) to an extended position (in which it is positioned adjacent the front or open end of a card pocket 92). As illustrated, this means might comprise a linkage 116 which is driven by a rotating drive 118, such as a crank mechanism which is driven by a motor. As illustrated, forward and/or reverse rotation of the drive causes the linkage 116 to move, such as back and forth about its pivot. In certain examples, this movement is controlled by the controller 175 of the shuffler 20.

As indicated, and as best illustrated in FIGS. 8A and 9, the card receiver 90 is movable, preferably in a vertical linear direction to a plurality of target positions (for delivering the cards to assigned pockets 92). A means is thus provided for moving the card receiver 90. In certain examples, the means comprises an elevator (for elevating—e.g. raising and/or lowering). In one example, the elevator comprises a motorized belt drive. As illustrated, a motor M4 may be configured to rotate belt B4 which rotates about a pulley 122. In one example, the card receiver 90 is coupled to the belt B4, such as by a connector 123. In this manner, as the belt B4 moves up and down, it pulls the card receiver 90 up and down. In one example, the motor M4 may comprise a stepper motor or motors of other types, and the motor might be configured to drive or move the card receiver 90 in other manners (e.g. direct drive, geared drive, etc.).

As described below, the controller 175 of the shuffler 20 may be used to control the operation of the motor M4, thus controlling movement and position of the card receiver 90. This control of the card receiver 90 allows for placement of cards into different card pockets 92 in a manner which "shuffles" the cards (i.e. randomizes them) and preferably allows them to be formed into hands. As one example, the controller 175 may use stored or input instructions to determine a number of groups of cards (hands or other groupings) that may need to be formed for a particular game. The controller 175 may implement a random number generator (RNG) in order to generate random positions for the cards, wherein the random positions comprise randomly selected or assigned card pockets for each card, considering the number of groups or hands which are to be formed. In this manner, while the cards from the card receiving area 70 are formed into groups or hands, they are also shuffled in the sense that they are randomly assigned to those groups or hands. In one example, the position for each incoming card (from the infeed mechanism) is generated by the controller 175 before the card reaches the card receiver 90. The controller 175 causes the card receiver 90 to be moved to a position in which each incoming card is fed into its randomly assigned card pocket 92 (such as by moving the card receiver 90 up and down, as necessary, to align the assigned card pocket 92 with each incoming card).

Card Eject

Once the cards are shuffled by associating them with the pockets 92 of the card receiver 90, they can then be delivered to the card dispensing area 72 for retrieval by the dealer. In certain examples, the shuffler 20 includes a card ejector 150 for moving cards from the card pockets 92 to the card dispensing area 72.

Figure 12:
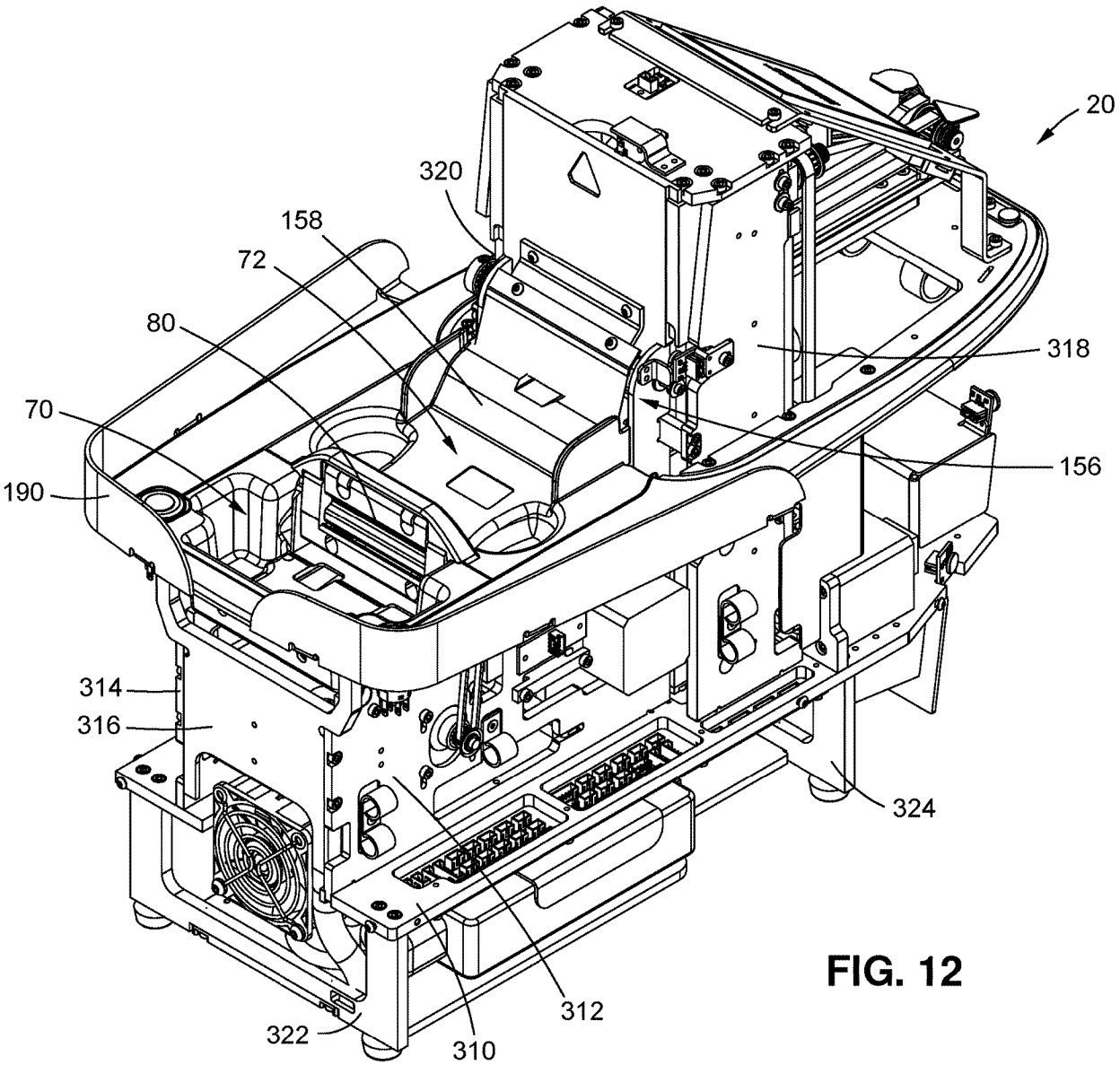
FIG. 12 is a view of the shuffler illustrated in FIG. 2 shown with portions of a housing removed.
Figure 14:
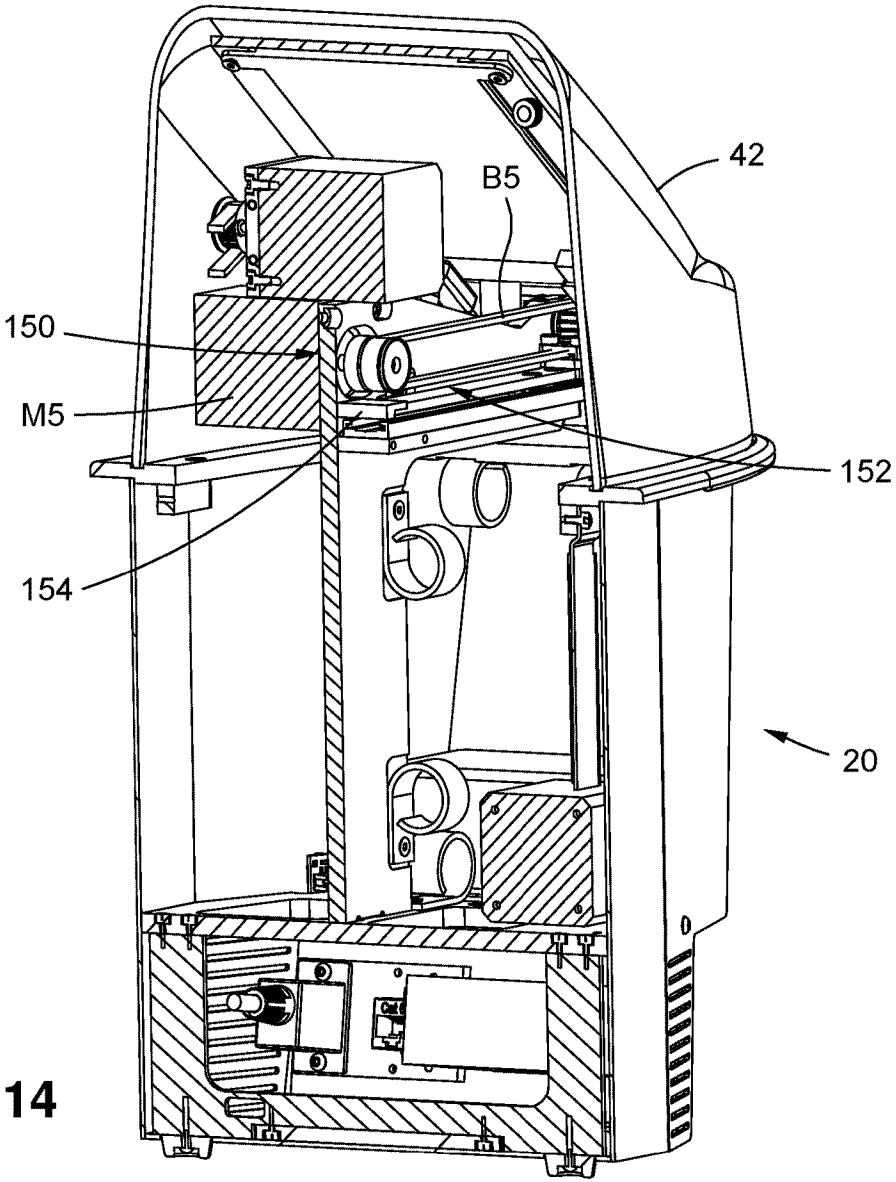
FIG. 14 is a cross-sectional view of the shuffler illustrated in FIG. 1 taken in the direction of line 14-14 therein.

Referring to FIGS. 8A, 12 and 14, in certain examples, the card ejector 150 comprises a pusher 152 and means for moving the pusher 152. The pusher 152 may comprise a body having a face 154. The pusher 152 is preferably movable from a retracted position in which it is positioned behind (in the direction of the front of the shuffler 20) the card receiver 90 so that it does not interfere with movement of the card receiver or placement of cards into the card pockets, and an extended position in which it extends into the channel 96 of the card receiver and can push cards in one of the pockets 92 rearwardly out of that pocket.

In certain examples, when it is desired to eject cards, the controller 175 moves the card receiver 90 into a position in which the pusher 152 is aligned with the desired card pocket 92. The pusher 152 is then extended, causing the face 154 to contact the cards in the aligned card pocket 92 and force them rearwardly.

In certain examples, the face 154 of the pusher 152 has a height which is equal to or greater than a height H of each card pocket 92 (e.g. the distance between the top of one card divider 94 and the bottom of the card divider 94 above it). In certain examples, the height H of each card pocket H is about 0.125-0.145 inches, and the height of the face 154 of the card pusher 152 is about 0.25 inches (whereby the height of the face 154 is greater than the distance between adjacent dividers 94, ensuring that the face 154 will contact and push all cards in a pocket 92 between two dividers 94 out of the card receiver 90, but where the height of the face 154 is not greater than the distance between two adjacent dividers 94, including the thicknesses of the dividers 94, whereby the pusher 152 will not push cards out of more than one pocket 92). As noted above, in one example, the card receiver 90 includes a central channel 96. In certain examples, the width of the pusher 152 is less than the width of the channel 96, thus allowing the pusher 152 to move into the channel 96, and thus between opposing portions of each card divider 94. Thus, when the pusher 152 is in its forward position, it is positioned inside of the card receiver 90, e.g. between the front and back of the card receiver at one of the card pockets 92, and thus forces any cards in that pocket rearwardly and out of the pocket. As noted above, because the height of the face 152 of the card pusher 152 is equal to or greater than the height of the card pocket 92, the card pusher 152 assuredly pushes all of the cards out of the corresponding pocket, no matter how many are in the pocket (e.g. the cards in the pocket cannot ride over the top of the pusher or the stack of cards in the pocket cannot be so high that the pusher does not engage all of them).

In certain examples, the ejected cards move generally horizontally and pass through a gate or opening 156 to the exterior of the shuffler 20 (behind the raised area 42 of the upper portion 24 of the housing 22), and onto a sloping card ramp 158 that leads to the card dispensing area 72. As best illustrated in FIG. 8A, the gate 156 may comprise a hinged or rotating door type structure which opens (to allow cards to pass therethrough) and closes (to obscure the interior of the shuffler from exterior view). The gate 156 may be moved by a means for moving, such as a motor or other drive.

As indicated, the pusher 152 is moved by a means for moving. In certain examples, this comprises belt B5 which is mounted on a first driven pulley 160 and a second idler pulley 161. A motor M5 drives the driven pulley 160, which in turn drives a belt B5. The pusher 152 is connected to the belt B5, such as by a clamp 163, whereby movement of the pulley 160 effectuates direct movement of the pusher 152.

In the example illustrated, and as described above, the cards are ejected at a vertical position of the shuffler 20 which is higher than the elevation or vertical position at which the cards are placed into the card receiving area 70 and delivered from the card receiving area 70 into the shuffler.

Additional features and benefits of the disclosure will now be described.

In certain examples, as illustrated in FIG. 8A, the shuffler 20 may include a card reader 180. The card reader 180 may comprise an image capture device (such as CCD, CMOS or other types now known or later developed), which is configured to capture an image of each card (or a portion thereof) that is shuffled. In certain examples, the card reader 180 may be configured to read or scan cards as they pass from the card receiving area 70 to the card shuffler, and particularly to capture an image of the bottom or "face" of each card (that bears the card distinguishing indicia, such as rank and suit). In this regard, as noted above, during this process, cards are individually moved in sequence from the card receiving area 70 to the card receiver 90, allowing each of them to be separately read. In other examples, the device might comprise other types of sensors for sensing, reading or otherwise capturing one or more elements of information about the cards, such as the card rank and/or suit or other identifying information of the card. Further, the location of the card reader 180 may vary.

In certain examples, the captured card information, such as the captured card images, is not used in the card shuffling process—e.g. is not used to determine the order or placement of the cards. As indicated above, this is done using an RNG and without regarding to the particular identity of each card. However, by scanning each card, the identity of each card can be matched to its determined location in the card receiver 90 (as determined by the RNG process) and each associated group of cards. In this manner, information is known regarding the cards dealt to each player, the dealer, to the community, etc., which information may be used for a variety of purposes (triggering bonuses, confirming game wins, etc.). In one example, the read card information is stored in association with information regarding the card's location (the assigned pocket), such as in a memory of the shuffler 20. In one example, the read card information and the card location for each card is generated and stored in the memory before each card reaches the card receiver 90. In one example, the stored card information may comprise an image of the read card information, while in others, the read card information might be transformed, such as from an image to data regarding the card (such as instead of an image of the card, the image information could be converted to information such as 8♣ ).

Card Shield

As indicated, in certain examples, cards are ejected through the gate 156 onto the ramp 158 that leads to the card dispensing area 72. As further described, in certain examples, the gate 156 (FIG. 8A) and card ramp 158 are elevated, thus allowing the cards to move down the ramp 158 from the gate 156 to the card dispensing area 72. Because the top of the card dispensing area 72 is generally level with the top of the lower portion 26 of the housing 22, it is thus at approximately the same level as the surface of a gaming table in which the shuffler 20 is installed. This means that the gate 156 is then located above the height of the table surface, raising the potential for persons to see the face of the cards (which are facing downwardly when ejected).

Figure 5:
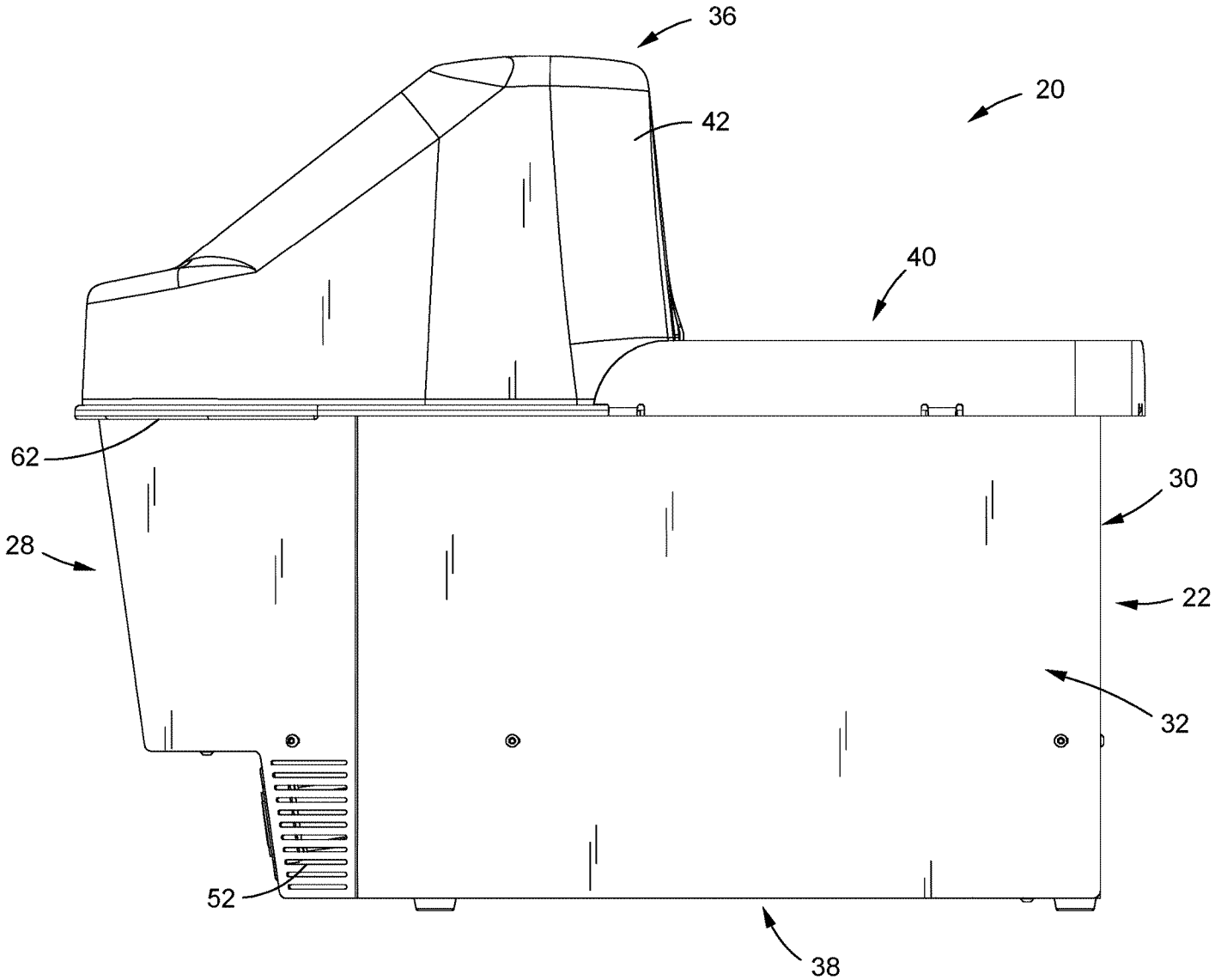
FIG. 5 is a first plan side view of the shuffler illustrated in FIG. 1.

Because this is undesirable, in certain examples, a card shield 190 may be provided. As illustrated in FIGS. 1, 2 and 5, the card shield 190 preferably comprises a wall or barrier that extends upwardly around at least a portion of the card area 40. The card shield 190 may be connected to the flange 62 (see FIG. 7) of the lower portion 26 of the housing 22 and then extend upwardly therefrom. In certain examples, the card shield 190 extends upwardly a sufficient height to prevent viewing of cards being ejected, such as by extending upwardly to approximately the same elevation as the gate 156, as illustrated in FIG. 8A. In certain examples, the card shield 190 is constructed from aluminum, plastic or a similar material, and is opaque to prevent persons from seeing through it. The card shield 190 may also serve additional functionality, such as a protector against spilled drinks or the like (wherein the upwardly extending configuration of the card shield 190 also reduces the potential for spilled liquid or the like from getting into the card area 40).

The card shield 190 may comprise one or more bodies or sections. As illustrated in FIG. 2, in certain examples, the card shield 190 comprises a first barrier 192 which is located at the first side 32 of the shuffler 20 and extends from generally the raised area 42 of the upper portion 24 of the housing 22 to the rear 30 of the shuffler 20, and a second barrier 192 which is located at the second side 34 of the shuffler 20 and extends from generally the raised area 42 of the upper portion 24 of the housing 22 to the rear 30 of the shuffler 20.

Of course, the card shield 190 might have other configurations, such as comprising a single barrier member or more than two. Further, the card shield 190 may be connected to the flange 62 in manners other than fasteners, such as screws. For example, the card shield 190 might be formed as an integral portion of the housing 20.

When the card shield 190 includes first and second barriers for location at generally opposing sides of the shuffler 20, in some examples, only one of the barriers might be used at a given time, such as depending upon the orientation of the shuffler 20 relative to the dealer and players. For example, only the first barrier 192 might be used or only the second barrier 192 might be used at a given time.

Belt Tensioner

As indicated above, in certain examples of the disclosure, a means for moving the card receiver 90 comprises an elevator, such as in the form a belt drive which comprises a motor M4 which drives a belt B4 (to which the card receiver 90 is connected, such as with one or more clamps) which is mounted drive element of the motor and an idler pulley 122. It is important to ensure that the card receiver 90 moves and stops quickly and precisely. Therefore, any deflection of belt B4 is problematic.

In certain examples, the shuffler 20 of the disclosure includes a belt tensioner 200. As illustrated in FIGS. 11A-D, the driven pulley 122 may be movably mounted, such as on a first movable mount 210. The first movable mount 210 is preferably movable linearly towards and away from the motor M4 and/or the element that the motor drives to turn the belt B4 (such as by slidable mounting of the first movable mount 210 to a frame element 312, described in more detail below). In this manner, the tension on the belt B4 may be increased (when the first movable mount 210 is moved upwardly in this example) or decreased (when the first movable mount 210 is moved downwardly in this example). In another examples, the position of the driving pulley might be movably mounted.

The belt tensioner 200 may include a tensioning adjuster. As best illustrated in FIG. 11D, a second movable mount 212 may also be provided, where the second movable mount 212 may also be configured for sliding/linear movement relative to the frame element 312). As illustrated, a resilient element such as a coil spring 214 is preferably positioned between the second movable mount and the first movable mount 210. Means are provided for adjusting the compression of the coil spring 214, and thus the force applied to the first movable mount 210. This means may comprise, for example, a threaded bolt 211 which passes through the movable mount 210 and engages second movable mount 212.

In use, the user may adjust the force applied to the first movable mount 210 by turning the bolt 211, thus compressing or decompressing the spring, thus changing the upward force on the first movable mount 210 via the spring 214. In order to set the desired tension on the belt, the user may release fasteners 213 which lock the first movable mount 210 in position. The user may then set the desired force on the movable mount 210 by turning the bolt 211 (which changes the distance between the first movable mount 210 and the second movable mount 212, and thus the biasing force generated by the spring 214 therebetween). When the desired upward force is applied to the first movable mount 210 (and thus the amount of tension on the belt B4), the user may lock the first movable mount 210 in position via one or more fasteners 213 (which are associated with the first moveable mount 210 and may move relative to a slot in the frame element 312). Advantageously, if the belt B4 stretches, the user can release the fasteners 213, adjust the force applied to the first movable mount 210, and then re-lock the first movable mount 210 in the newly adjusted position. This adjustment might be performed during designated maintenance on the shuffler 20.

Construction and Calibration

Another aspect of the disclosure comprises a construction of the shuffler 20, including the design and interconnection thereof to accommodate and maintain tight tolerances. As best illustrated in FIG. 12, various components of the shuffler 20 may be associated with a frame. The frame may be located within the housing 22 and the various portions of the housing 22 may thus cover and/or connect to the frame.

In certain examples, the frame may comprise a base or base plate 310, such as a generally planar plate comprising machined aluminum. Elements of the card infeed system, including the motors M1-M3, the rollers 84 and associated features (including, as illustrated, elements of the shuffler 20 that comprise or define the card receiving area 70 and card dispensing area 72) may be associated with first and second vertical supports 312,314 that extend upwardly from the base plate 310 (and are spaced from one another). Other frame elements, such as an end cap 316 or other elements, may be associated with the base plate 310 and/or first and second vertical supports 312,314.

In certain examples, the movable card receiver 90 is associated with third and fourth vertical supports 318,320. The third and fourth vertical supports 318,320 are also connected to the base plate 310. The first and second vertical supports 312,314 may also be connected to the third and fourth vertical supports 318,320.

As illustrated in FIG. 12, the frame may include other elements, such as one or more downwardly extending supports 322,324, such as for supporting the shuffler 20.

The various elements of the frame may be connected to one another in various manners, such as with fasteners. In certain examples, one or more of the frame elements may be interconnected, such as in a tab and slot arrangement. Such a configuration aids in ensuring that the frame elements are maintained in alignment (because of the rigidity of the frame elements themselves and the contact of the frame elements with one another, rather than merely by fasteners alone, which can loosen and also not adequately counter-act bending forces). Secondarily, fasteners may be used to join the frame members, such as for further counter-acting bending forces.

In certain examples, a means may be provided for adjusting the position of one or more components of the shuffler 20, such as to ensure continued alignment of the components. In certain examples, this means may comprise a means for adjusting the position of the card receiver 90 relative to the card infeed mechanism. As described above, in certain examples, cards are fed in along a generally linear and horizontal path from the card receiving area 70 to the card receiver 90. It is important to maintain alignment of the card receiver 90 relative to the card infeed mechanism in order to ensure that cards are properly fed to the card receiver 90—including so that the cards impact the card ramps 98 of the card dividers 94 and are directed to the proper card pockets 92.

Figure 11B:
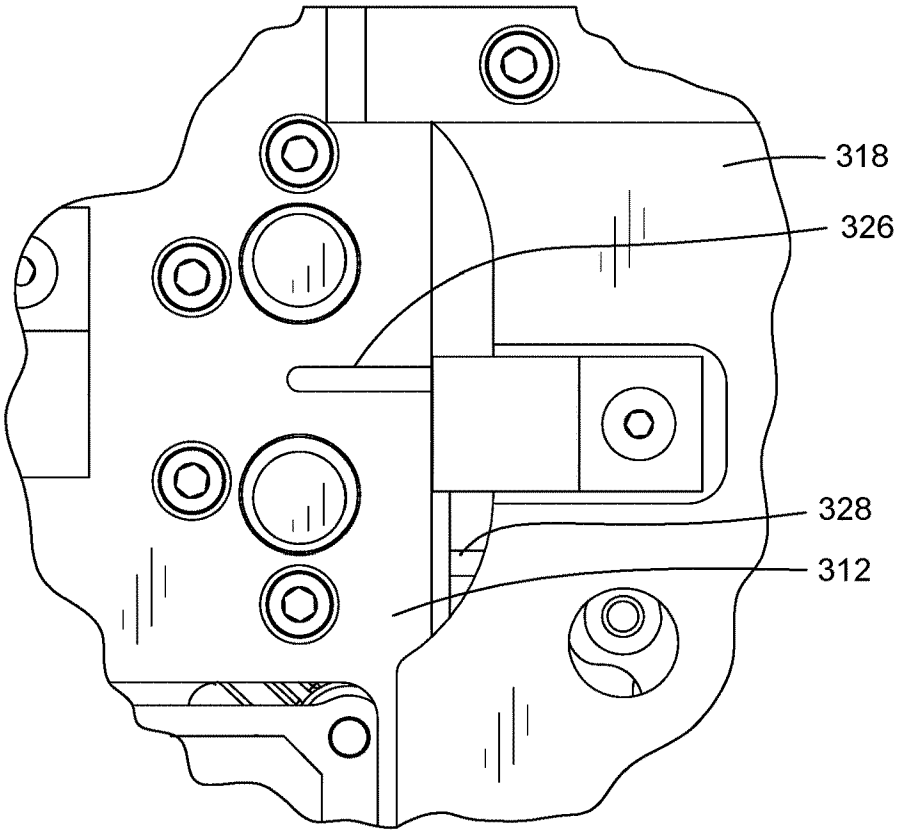
FIG. 11B is an enlarged view of the indicated portion of FIG. 11A.
Figure 11D:
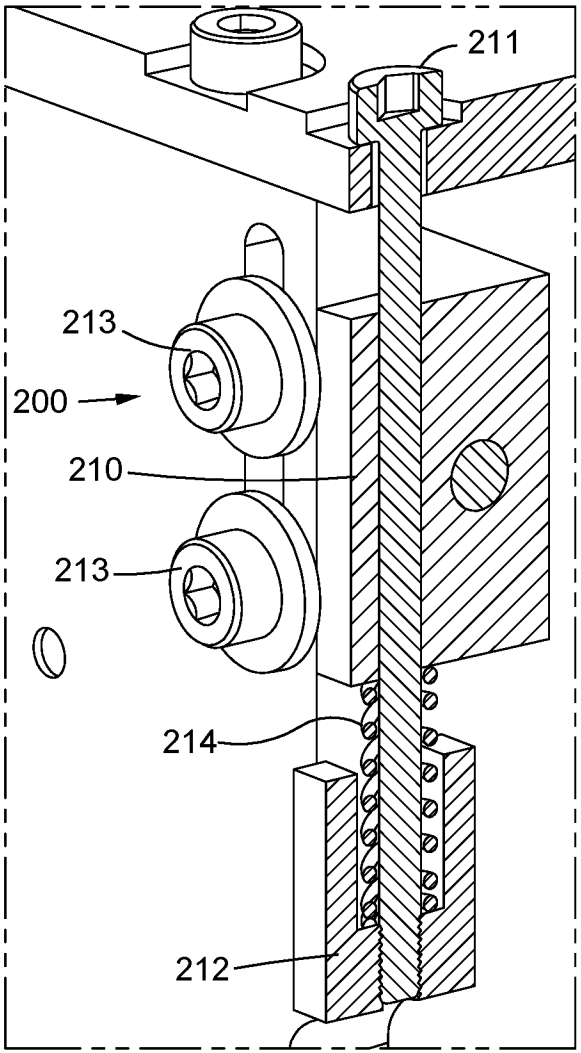
FIG. 11D is a cross-sectional view of the indicated portion of FIG. 11C.

In certain examples, as illustrated in FIG. 11B, a first calibration mark or indicator 326 may be provided on a portion of the frame which supports the card infeed mechanism, such as the first vertical support 312. A second calibration mark or indicator 328 may be provided on a portion of the card receiver 90.

In one example, a user (such as a technician) may calibrate the shuffler 20 by aligning the calibration marks (in that over time, the position of the card receiver 90, etc., may get out of alignment). As one example, the user may access a calibration feature, such as by a menu of the controller (which is described below). The calibration feature may, for example, allow the user to provide up/+ or down/− inputs which the controller uses to cause the motor M4 to move, thereby adjusting the position of the card receiver 90, until the technician confirms that the calibration marks are aligned (by visual inspection and continued adjustment inputs). In other examples, the calibration might be manual, such as by providing one or more adjustment screws or bolts which, when turned, cause the position of one or more of the elements of the shuffler 20 to move.

Controller

Figure 15:
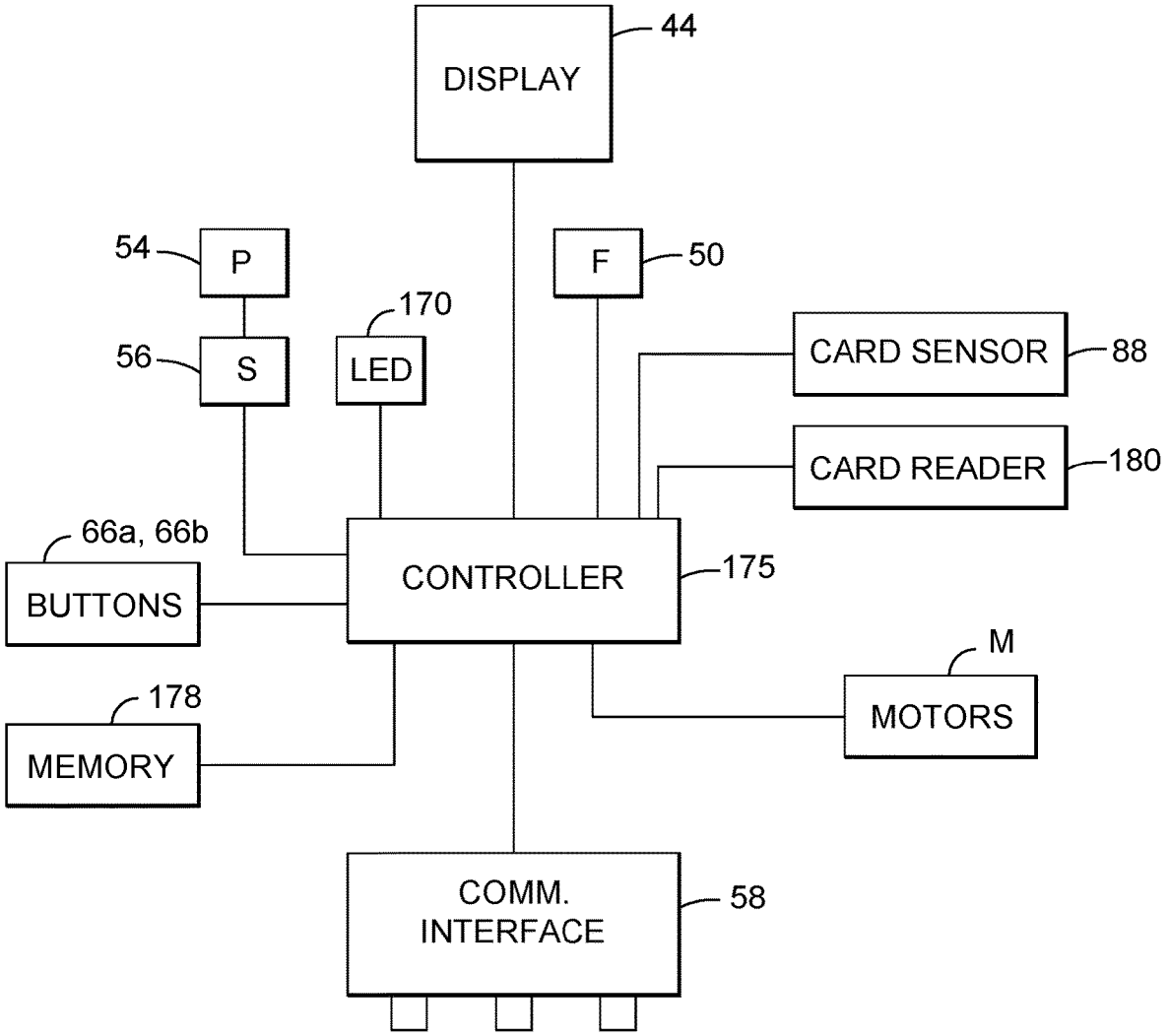
FIG. 15 is a schematic diagram of a controller and associated components of the shuffler illustrated in FIG. 1.

As indicated above, operation of the shuffler 20 is preferably controlled by a controller 175. The controller 175 may comprise hardware and/or software, such as a processor which executes machine-readable code (e.g. software) which is stored in a memory 178. As illustrated in FIG. 8A, one or more of the components of the controller 175 may be associated with a circuit or motherboard. As illustrated in FIG. 15, the controller 175 may be configured to receive information, including inputs or data from external devices and systems via the one or more communication ports or interfaces 58, one or more buttons 66*a,b*, the card sensor 88, a card reader 180 (as described below) or other input devices of the shuffler 20. The controller 175 may also be configured to illuminate the indicators 170 and cause information to be displayed on the video display 64. The controller 175 is also configured to control other elements of the shuffler 20, such as the various motors (including motors M1-M5) or other drive mechanisms, including for moving the card receiver 90, the moveable side wall 80, the card ejector 150, etc., the fan(s) 50, etc.

It will be appreciated that the shuffler 20 may include, and the controller 175 may thus communicate with, a variety of sensors other than those described in detail above. For example, aside from the card infeed sensor 88, other sensors such as motor, card or other sensors might be provided for enabling and/or confirming operation of the shuffler 20. For example, various sensors might be used to detect motor positions, the absence or presence of portions of the housing 22, the presence of one or more cards in the card receiver 90, the presence of cards in the card dispensing area 72 (such as used to determine when to eject another set of cards) and/or the location or movement of cards. For example, one or more sensors may be used to determine the flow of cards through one or more portions of the shuffler 20, such as from the card receiving area 70 to the card receiver 90. In one example, these sensors might comprise "cut-beam" type sensors (where the presence of a card cuts an emitted light beam), and where the one or more sensors may be positioned so that movement of the cards is detected in manner which can be used to determine if the cards are moving at a target rate or speed (where if the beams emitted by the sensors are not cut or triggered at designated times or time intervals so as to indicate normal flow of cards, a fault condition may be triggered). As indicated, the sensors may be of various types, such as beam sensors, Hall-Effect sensors, pressure, contact or other types.

In certain examples, as described above, the controller 175 is configured to randomize cards via random assignment of cards to the pockets 92 of the card receiver 90. As indicated, in certain examples, the controller 175 implements a random number generator (RNG). Generated random numbers are correlated or assigned to the card pockets 92. Individual cards are moved to a card pocket 92 as determined by the RNG, whereby the placement of the cards is fully randomized.

In certain examples, the controller 175 is configured to generate one or more groups of cards, such as one or more hands or sets of cards. The number of groups or sets and the number of cards of each group of set might be defined by the game which is being played. For example, in a game of stud poker where each player receives five (5) cards and four (4) players are playing the game, the controller may be configured to cause a deck of cards to be randomized into the card slots and then delivered (ejected) from the cards slots into four groups of five cards, one group for each player hand.

In certain examples, the controller 175 is configured to only cause information to be displayed on the one or more video displays 64 in response to a user input, such as the one or more buttons 66*a,b* or a touch-device or screen (such as associated with the video display 64) or other input device. In one example, the buttons 66*a,b* comprise first and second buttons which are located at or adjacent to the card receiving and dispensing area 40. For example, as illustrated in FIG. 1, the buttons 66*a,b* might be located adjacent to the card receiving area 70, such as near the flange 62. The buttons 66*a,b* might be of various types which are configured to receive user input, such as via touch or depression. The buttons 66*a,b* might comprise one or more visual indicators, such as a light or light ring, wherein the visual indicator might be selectively illuminated, such as in different colors.

In certain examples, at least one indicator 170 (such as LEDs) may provide information to the user. The indicators 170 might be provided, for example, at the control panel 44 portion of the shuffler 20. As illustrated, the indicators 170 might be located adjacent to the display 64. However, it might be located in other positions. In one example, the indicators 170 might be illuminated in different colors (such as green (normal operation), yellow (indicating required input by the user to the shuffler) and red (warning condition, such as requiring technician intervention)). In one example, the visual indicators of the buttons 66*a,b*, may be synchronously illuminated to the indicator(s) 170.

In certain examples, when the controller 175 is awaiting instructions or input by a user, it may activate the indicators 170 and buttons 66*a,b*, such as by illuminating the LEDs in yellow. The user is then alerted that they need to provide input to the controller, such as to cause the controller to display certain information to the user, including instructions, options or other information. This input might comprise input to a button 66*a,b* and/or input to the display 64.

In certain examples, the controller 175 may, in response to such user input, be configured to display various information in response to user input, such as information regarding options to begin shuffling, create hands for particular games, stop shuffling, display shuffled hand information, or other information. The user may provide input, such as relative to such selections, to cause the shuffler 20 to initiate shuffling, including creating shuffled hands for a particular game.

As indicated, the shuffler 20 is preferably configured to shuffle cards and create one or more groups of cards, such as hands which are required for the play of a game. The controller 175 may allow the user to select a particular game being played and/or other parameters, so that the controller can control the shuffler 20 to create the correct number of hands (whether player or dealer hands) and/or community card sets, including with the correct or desired number of cards per hand/set. In some examples, the controller 175 may be programmable (such as via external connection to another device, such as a laptop or server) in order to reprogram the controller, such as to include information regarding additional or new games, and/or the user may be permitted to similarly program the controller. Game or other information, such as the number of sets of cards, number of cards per set, etc., may be stored in the memory and be used by the processor to generate the required number of sets or hands of cards and/or sets or hands of cards with particular numbers of cards, for different types of games.

Figure 16:
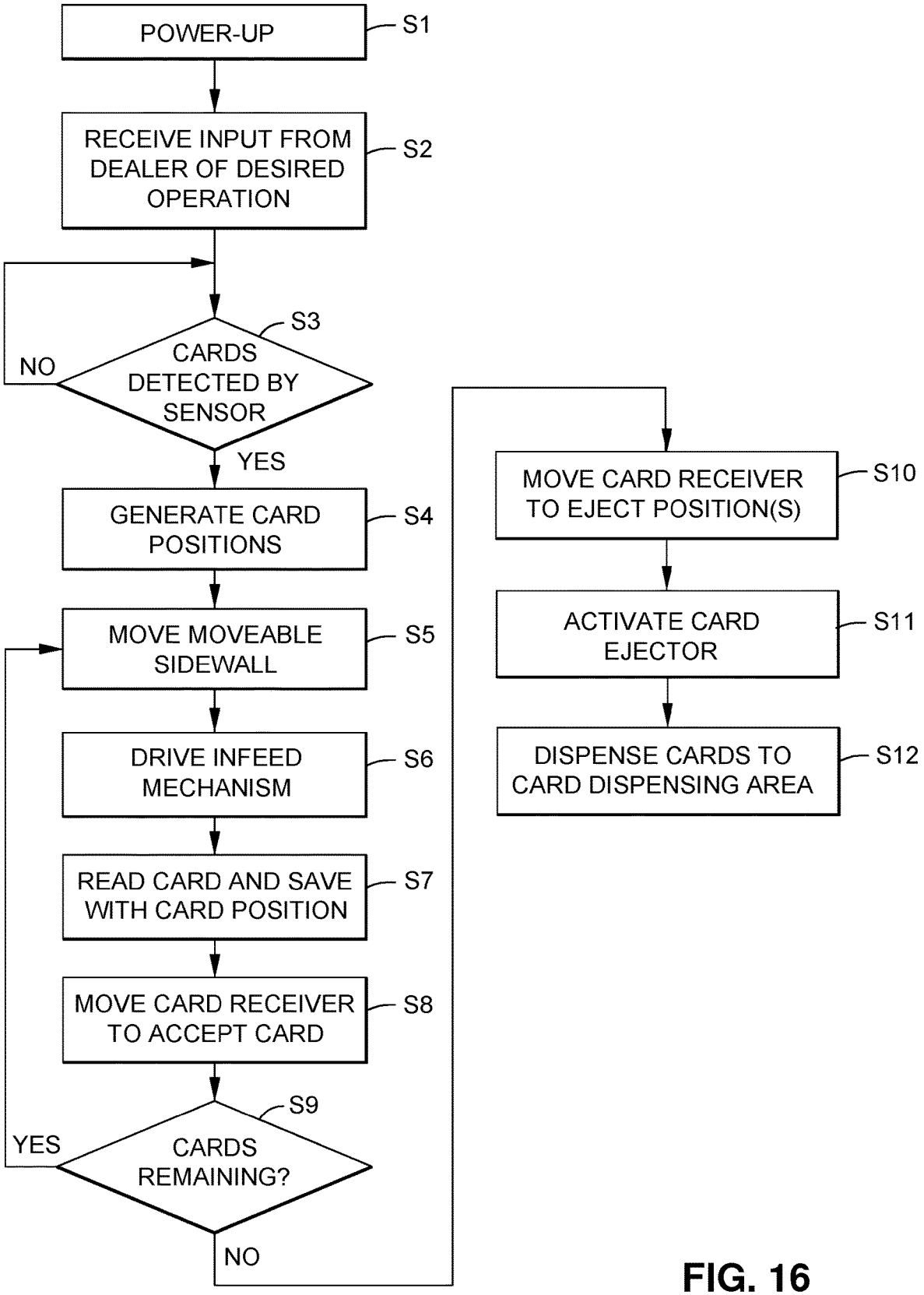
FIG. 16 is a flow diagram of a method of operation of the shuffler illustrated in FIG. 1.

FIG. 16 illustrates one example flow of the general operation of the shuffler 20. In a step S1, the shuffler 20 may be powered on, such as by use of the power switch 56, if the shuffler is not already powered on. In a step S2, the dealer may provide input of a particular operation, such as by selecting an option from a menu or list displayed by the display 64, such as via the associated touch-screen. The option may comprise, for example, a shuffling and hand-dealing operation associated with a particular game.

In step S3, the controller 175 may be configured to receive the selected operation input and then check for cards in the card receiving area 70, such as based upon an output of the card sensor 88. If no cards are detected, the operation may repeat until the dealer places cards into the card receiving area 70. At this time, the movable side wall 80 is located in its vertical position.

When cards are detected in the card receiving area 70, the controller 175 may generate random numbers and utilize those random numbers to assign card positions to each card, wherein the card positions correspond to card pockets 92 of the card receiver 90, as in step S4. The controller 175 may then activate the movable sidewall 80, such as by activating motor M1, in order to begin processing of the cards, as at step S5. As indicated above, this activation may cause the movable sidewall 80 to move from a vertical position to a tilted position in which it contacts the cards in the card receiving area 70. At the same time, the controller 175 preferably actuates or drives the card infeed mechanism, such as by activating motor M2 and driving the rollers 84, thus drawing cards from the bottom of the card receiving area 80, such as indicated at step S6.

In step S7, each in-fed card may be read by the card reader 180 and the card information may be stored in the memory 178, such as in association with the assigned position for the card.

The controller 175 preferably moves the card receiver 90 (such as by activation of motor M4) so that the pocket 92 to which each card is assigned is aligned with the incoming card, allowing each card to be moved to its assigned pocket, as in step S8. In one example, this process of in-feeding cards and directing them to pockets continues until all cards have been processed from the card receiving area 70 (at which point the infeed mechanism may be deactivated, including by moving the movable sidewall 80 back to its vertical position and turning off the motors M2 and M3 which drive sets of the rollers 84).

The cards may then be ejected. As indicated, in step S10, the controller 175 may cause the card receiver 90 to move vertically up and down so that individual pockets 92 are aligned with the card ejector 150. The controller 175 may then activate the card ejector 150, causing the pusher 152 to push the cards associated with a pocket 92 out of the card receiver 90, as at step S11, so that the cards are dispensed into the card dispensing area, as reflected at step S12, where they may be retrieved by the dealer. As indicated herein, in one example, the controller 175 is configured to process the cards into one or more groups, such as hands, whereby the hands (whether player hands, a dealer hand, one or more community cards, etc.) are dispensed to the card dispensing area 72 for retrieval by the dealer.

Advantages and Other Aspects of the Design

The shuffler 20 may have various advantages and solve various problems over existing shuffling or card handling devices.

Advantages of the top of the card dispensing area 72 being higher than the top of the card receiving area 70 may be that it facilitates a card receiver 90 (described below) that has numerous card slots or pockets 92, while still permitting the card receiver 90 to have the range of motion (in the vertical direction) which is necessary to both align the pockets thereof with cards being fed into the pockets by the card infeed mechanism of the shuffler, and also to allow the card receiver 90 to move vertically to a position in which the pockets 92 can be aligned with the card ejector 150.

As indicated, another feature of the disclosure is a shuffler 20 having a card receiving area 70 with a moveable sidewall 80. The moveable sidewall 80 forms a portion of the card receiving area 70, such as one sidewall thereof, when in a first or vertical position. At the same time, the movable sidewall 80 can be tilted into the card receiving area 70 to engage the top of the one or more cards therein, thus aiding in forcing the cards downwardly to be drawn from the bottom of the card receiving area 70 into the shuffler 20 by the infeed mechanism. This design is compact and does not require a separate arm or weight that takes up space in the shuffler 20 and requires other components to be relocated.

It will be understood that the above described arrangements of apparatus and the method there from are merely illustrative of applications of the principles of this disclosure and many other embodiments and modifications may be made without departing from the spirit and scope of the disclosure as defined in the claims.

What is claimed is:

1. A card shuffler comprising:

a housing, said housing defining a card receiving area, said card receiving area having a generally open top and a bottom, said card receiving area defined by a first sidewall and a generally opposing, spaced second sidewall, a first endwall extending between said first and second sidewalls, and a second endwall also extending between said first and second sidewalls, said second endwall generally opposing and spaced from said first endwall, said first and second sidewalls and said first and second endwalls each extending generally vertically upward from said bottom towards said top of said card receiving area, and a divider, said divider having a top which is located above said top of said card receiving area, at least a portion of said first sidewall comprising a movable sidewall, said movable sidewall movable between a first retracted, generally vertical position where a top of said movable sidewall extends above said top of said card receiving area but is positioned below said top of said divider, and a second non-vertical position, wherein when said movable sidewall is located in said vertical position, one or more cards may be placed into said card receiving area through said open top, said one or more cards bounded by said first and second sidewalls and said first and second endwalls, and wherein when said movable sidewall is in said second non-vertical position, at least a portion of said movable sidewall extends into said card receiving area for engaging one or more of said cards therein;

a card receiver located in said housing;

a card infeed mechanism configured to feed cards from said card receiving area and deliver said cards to said card receiver;

a card ejector configured to move cards out of said card receiver and into a card dispensing area; and a controller configured to control said movable sidewall, said card receiver, said card infeed mechanism and said card ejector.

2. The card shuffler in accordance with claim 1, wherein when said portion of said first sidewall comprising said movable sidewall is in said first position, at least a portion of said movable sidewall is located in a recess in said divider with a portion of said divider positioned vertically above and covering said top of said moveable sidewall.

3. The card shuffler in accordance with claim 2, wherein said divider separates said card receiving area and said card dispensing area.

4. The card shuffler in accordance with claim 1, wherein said portion of said first sidewall comprising said movable sidewall is pivotally connected to said housing.

5. The card shuffler in accordance with claim 4, wherein said movable sidewall is pivotally connected at a bottom portion thereof to said housing.

6. The card shuffler in accordance with claim 1, wherein when in said second position said at least a portion of said movable sidewall extends into said card receiving area and contacts a top card of one or more cards located in said card receiving area.

7. The card shuffler in accordance with claim 1, wherein said controller is configured to cause said movable sidewall to move to said second position upon receiving a signal that one or more cards have been placed into said card receiving area.

8. The card shuffler in accordance with claim 7, further comprising at least one card sensor associated with said card receiving area, said signal provided by said at least one card sensor.

9. The card shuffler in accordance with claim 7, wherein said controller is configured to cause said movable sidewall to move to said first position when no cards are located in said card receiving area.

10. The card shuffler in accordance with claim 1, wherein a top of said card dispensing area is located above said opening of said card receiving area.

11. The card shuffler in accordance with claim 1, wherein said opening of said card receiving area is generally coplanar with a flange of said housing and said top of said card dispensing area is located above said flange.

12. The card shuffler in accordance with claim 1, wherein said card infeed mechanism is configured to deliver said cards generally horizontally from said card receiving area to said card receiver.

13. A card shuffler comprising:

a housing, said housing defining a card receiving area for receiving one or more cards;

a movable card receiver located in said housing;

a card infeed mechanism configured to feed cards from said card receiving area and deliver said cards to said movable card receiver;

a card ejector configured to move cards out of said card receiver and into a card dispensing area; and a controller configured to control said movable card receiver, said card infeed mechanism and said card ejector;

said movable card receiver comprising a plurality of vertically arranged dividers, said plurality of dividers defining a plurality of vertically spaced card pockets, said card pockets configured to receive at least one card delivered by said card infeed mechanism, said movable card receiver movable between one or more raised and one or more lowered positions, said movable card receiver having a front and a rear, said card infeed mechanism located forwardly of said front of said movable card receiver for delivering said cards into said card pockets from said front of said movable card receiver, said card ejector located rearwardly of said rear of said movable card receiver and configured to move said cards forwardly out of said movable card receiver at said front thereof.

14. The card shuffler in accordance with claim 13, wherein said dividers have a front and a rear and a top and a bottom, wherein a front of one or more of said dividers defines a first ramp at a top thereof.

15. The card shuffler in accordance with claim 14, wherein said card infeed mechanism is located at a first elevation in said housing and said card ejector is located at a second elevation in said housing, said second elevation being higher than said first elevation.

16. The card shuffler in accordance with claim 13, further comprising at least one card reader configured to read information regarding said cards being fed from said card receiving area to said movable card receiver by said card infeed mechanism.

17. The card shuffler in accordance with claim 13, wherein a plurality of said pockets are defined between dividers having a top and a bottom and a ramp at a front of the divider only at the bottom thereof, and a plurality said pockets are defined between dividers having a top and a bottom and ramps at a front of the dividers at both the top and bottom thereof.

18. A card shuffler comprising:

a housing, said housing having a first end and a second end, said housing defining a card receiving area for receiving one or more cards, said card receiving area having a generally open top and a bottom, and said housing defining a card dispensing area into which cards are dispensed, said card dispensing area having a generally open top and a bottom, said card receiving area located at said first end of said housing and said card dispensing area separated from said card receiving area by a divider in the direction of said second end, said housing defining a card eject opening through which cards are ejected through said eject opening, a bottom of said card dispensing area adjacent to said card eject opening being higher than said bottom of said card dispensing area adjacent to said divider, said top of said card receiving area located in a first plane and said top of said card dispensing area located in a second plane, said second plane being located above said first plane;

a movable card receiver located in said housing;

a card infeed mechanism configured to feed cards from said card receiving area and deliver said cards to said movable card receiver;

a card ejector configured to move cards out of said card receiver and through said card eject opening into said card dispensing area; and a controller configured to control said movable card receiver, said card infeed mechanism and said card ejector.

19. The card shuffler in accordance with claim 18, wherein said opening of said card receiving area is generally coplanar with a flange of said housing and said top of said card dispensing area is located above said flange.

20. The card shuffler in accordance with claim 18, wherein said bottom of said card dispensing area slopes downwardly from said card eject opening to said divider.

* * * * *